US009439502B2

(12) United States Patent
Topf et al.

(10) Patent No.: US 9,439,502 B2
(45) Date of Patent: Sep. 13, 2016

(54) HANDHELD TOOL FOR APPLYING A FLUID ONTO A SURFACE

(71) Applicant: The Boeing Company, Chicago, IL (US)

(72) Inventors: Richard Philip Topf, Orange, CA (US); Cris Howard Garcia, Long Beach, CA (US); Ilya Sedler, Huntington Beach, CA (US)

(73) Assignee: THE BOEING COMPANY, Chicago, IL (US)

( * ) Notice: Subject to any disclaimer, the term of this patent is extended or adjusted under 35 U.S.C. 154(b) by 122 days.

(21) Appl. No.: 14/179,895

(22) Filed: Feb. 13, 2014

(65) Prior Publication Data

US 2015/0223596 A1 Aug. 13, 2015

(51) Int. Cl.

| | |
|---|---|
| ***A46B 5/02*** | (2006.01) |
| ***A46B 13/04*** | (2006.01) |
| ***A46B 11/00*** | (2006.01) |
| ***B05C 1/06*** | (2006.01) |
| ***B05C 11/02*** | (2006.01) |
| ***B05C 17/00*** | (2006.01) |
| ***A46B 13/06*** | (2006.01) |

(52) U.S. Cl.

CPC ..... *A46B 13/04* (2013.01); *A46B 11/001* (2013.01); *A46B 13/06* (2013.01); *B05C 1/06* (2013.01); *B05C 11/02* (2013.01); *B05C 17/00* (2013.01)

(58) Field of Classification Search

CPC ..... A46B 13/04; A46B 11/001; B05C 11/02; B05C 17/00; B05C 1/06

USPC ..... 401/4–6, 266, 270; 222/389

See application file for complete search history.

(56) References Cited

U.S. PATENT DOCUMENTS

| | | | | |
|---|---|---|---|---|
| 4,932,094 | A | 6/1990 | McCowin | |
| 6,292,971 | B1 * | 9/2001 | Chaudray | A46B 11/063 15/22.1 |
| 7,363,673 | B2 | 4/2008 | Schonewille et al. | |

OTHER PUBLICATIONS

Topf et al., "Control Valve Having a Disposable Valve Body," U.S. Appl. No. 13/886,535, filed May 3, 2013, 52 pages.

Tomuta et al., "Tool for Applying a Fluid onto a Surface," U.S. Appl. No. 14/016,846, filed Sep. 3, 2013, 59 pages.

* cited by examiner

*Primary Examiner* — Jennifer C Chiang

(74) *Attorney, Agent, or Firm* — Yee & Associates, P.C.

(57) ABSTRACT

A method and apparatus for applying a fluid onto a number of surfaces. The apparatus comprises a structure, an applicator associated with the structure, a first control device associated with the structure, and a second control device associated with the structure. Applying a first force to the first control device causes the applicator to move relative to a center axis of the applicator. Applying a second force to the second control device causes the fluid to be delivered from a fluid dispensing system to the applicator.

21 Claims, 16 Drawing Sheets

HANDHELD TOOL FOR APPLYING A FLUID ONTO A SURFACE

BACKGROUND INFORMATION

1. Field

The present disclosure relates generally to applying a fluid onto a surface and, in particular, to a tool for applying a fluid onto a surface. Still more particularly, the present disclosure relates to a method and apparatus for integrating the dispensing and delivery of a fluid to an applicator and the application of the fluid onto one or more surfaces by the applicator.

2. Background

Some manufacturing and assembly operations may require that a high-viscosity fluid be applied onto the surfaces of various objects. As one illustrative example, certain assembly operations may require that a coat of sealant material be applied over the exposed ends of installed fasteners. The coat of sealant material may need to be applied in a manner that completely covers the exposed ends of the fasteners and the surfaces around the fasteners.

Oftentimes, manual tools are used to apply high-viscosity fluids, such as, for example, but not limited to, sealant materials, onto surfaces. An example of one of these tools is a brush that has a handle with bristles attached to the handle. For example, a brush may be used to brush a coat of sealant material over an exposed end of a fastener element installed in an object and over a portion of the surface of the object surrounding the exposed end of the fastener element. A human operator, such as a qualified sealer, may dip the bristles of the brush into a container of sealant material and then use the bristles to brush the sealant material over the fastener element.

When sealant material is to be applied over hundreds of fasteners, the human operator may need to frequently re-dip the bristles of the brush into the container of sealant material. In some cases, the brush may need to be wrung on the lip of the container each time the brush is dipped into the sealant material to remove excess sealant material from the brush prior to application. The human operator may apply the sealant material over the fasteners by moving the brush back and forth multiple times over each of the fasteners to ensure complete coverage of the ends of the fasteners.

This type of manual application of sealant material may be more time-consuming and require more effort than desired. Further, this type of manual application of sealant material may be more tiring for the human operator than desired. Additionally, this type of process may require a human operator to have a certain level of skill and knowledge to prevent over-application or under-application of the sealant material. Therefore, it would be desirable to have a method and apparatus that take into account at least some of the issues discussed above, as well as other possible issues.

SUMMARY

In one illustrative embodiment, an apparatus comprises a structure, an applicator associated with the structure, a first control device associated with the structure, and a second control device associated with the structure. Applying a first force to the first control device causes the applicator to move relative to a center axis of the applicator. Applying a second force to the second control device causes a fluid to be delivered from a fluid dispensing system to the applicator.

In another illustrative embodiment, an integrated system comprises a brace, a fluid dispensing system associated with the brace, and a tool. The brace is configured to be worn around an arm of a human operator. The fluid dispensing system is configured to dispense a fluid. The tool is configured to be held by the human operator. The tool comprises a structure, an applicator associated with the end of the structure, a movement system associated with the structure, and a delivery system associated with the structure. The structure has a shape configured to allow an end of the structure to reach a desired location within an area. The movement system is configured to move the applicator relative to a center axis of the applicator in response to a first force being applied to a first control device in the movement system. The delivery system is configured to deliver the fluid from the fluid dispensing system to the applicator in response to a second force being applied to a second control device in the delivery system.

In yet another illustrative embodiment, a method for applying a fluid onto a number of surfaces is provided. An applicator associated with a structure is moved over the number of surfaces in response to a first force being applied to a first control device associated with the structure. The fluid is delivered to the applicator from a fluid dispensing system in response to a second force being applied to a second control device associated with the structure. The fluid is applied onto the number of surfaces with a desired level of coverage using the applicator while the fluid is being delivered to the applicator and while the applicator is being moved.

The features and functions can be achieved independently in various embodiments of the present disclosure or may be combined in yet other embodiments in which further details can be seen with reference to the following description and drawings.

BRIEF DESCRIPTION OF THE DRAWINGS

The novel features believed characteristic of the illustrative embodiments are set forth in the appended claims. The illustrative embodiments, however, as well as a preferred mode of use, further objectives and features thereof, will best be understood by reference to the following detailed description of an illustrative embodiment of the present disclosure when read in conjunction with the accompanying drawings, wherein:

DETAILED DESCRIPTION

The illustrative embodiments recognize and take into account different considerations. For example, the illustrative embodiments recognize and take into account that it may be desirable to have a tool for applying sealant material over a surface that can be integrated with a fluid dispensing system such that the application process can be at least partially automated. The illustrative embodiments recognize and take into account that at least partially automating movement of a brush used to apply sealant material may reduce the time needed to apply the sealant material. Further, automating movement of the brush may reduce the effort required by a human operator during application of the sealant material.

The illustrative embodiments also recognize and take into account that it may be desirable to at least partially automate the dispensing and delivery of sealant material to a brush during application of the sealant material. Having a system capable of dispensing and delivering sealant material to a brush while the brush is being moved over a surface onto which sealant material is to be applied may reduce the overall time and effort required during the application process.

Thus, the illustrative embodiments provide an apparatus, system, and method for applying a fluid, such as sealant material, onto one or more number of surfaces. As one illustrative example, an integrated system for dispensing and delivering fluid to a tool as the tool is being moved over a surface to apply the fluid onto the surface is provided. The tool may be a handheld tool and capable of reaching within hard-to-reach areas. An example of one implementation for this type of integrated system is described in FIGS. 1-9 below.

Figure 1:
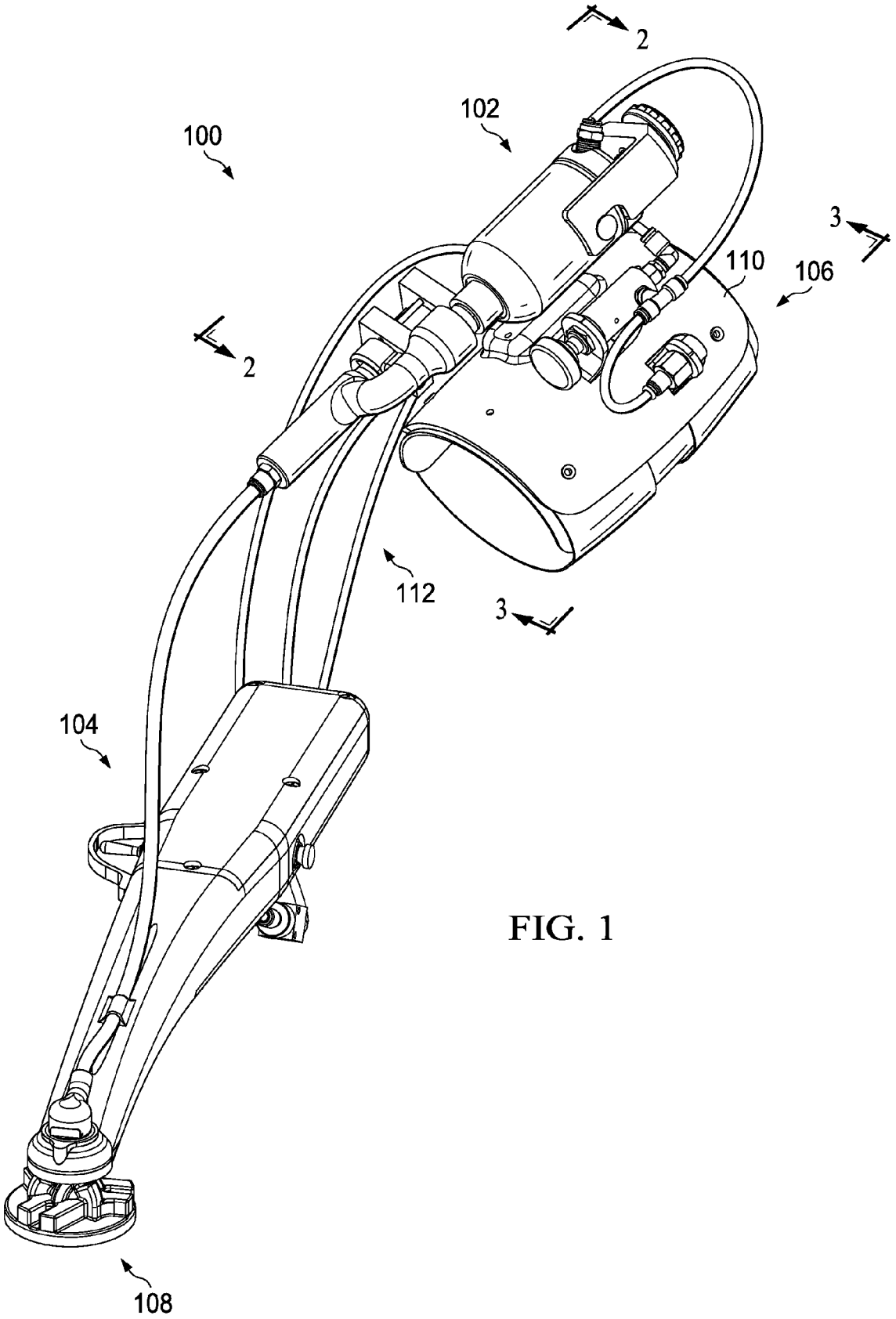
FIG. 1 is an illustration of an integrated system for dispensing and applying a fluid in accordance with an illustrative embodiment.

Referring now to the figures and, in particular, with reference to FIG. 1, an illustration of an integrated system for dispensing and applying a fluid is depicted in accordance with an illustrative embodiment. As depicted, integrated system 100 includes fluid dispensing system 102, tool 104, and brace 106. Further, tool 104 includes applicator 108.

In this illustrative example, fluid dispensing system 102 is configured to dispense a fluid for delivery to applicator 108 of tool 104. The fluid dispensed from fluid dispensing system 102 may be a high-viscosity fluid such as, for example, without limitation, a sealant material. A high-viscosity fluid may be a fluid having a viscosity above, for example, about 1000 centipoise.

In this example, tool 104 is configured to be held by a human operator. In other words, tool 104 is a handheld tool. As depicted, fluid dispensing system 102 is associated with brace 106 through mounting plate 110.

As used herein, when one component is "associated" with another component, the association is a physical association in the depicted examples. For example, a first component, such as fluid dispensing system 102, may be considered to be associated with a second component, such as brace 106, by being at least one of secured to the second component, bonded to the second component, mounted to the second component, welded to the second component, fastened to the second component, or connected to the second component in some other suitable manner. The first component also may be connected to the second component using a third component. Further, the first component may be considered to be associated with the second component by being formed as part of the second component, an extension of the second component, or both.

In this illustrative example, mounting plate 110 is considered separate from brace 106. However, in other illustrative examples, mounting plate 110 may be considered part of brace 106. Brace 106 is configured to be worn around the arm of a human operator.

Integrated system 100 also includes plurality of lines 112. Plurality of lines 112 connects fluid dispensing system 102 to tool 104. In this illustrative example, plurality of lines 112 includes lines for carrying both fluid and air. The different components of fluid dispensing system 102 and brace 106 are described in greater detail in FIGS. 2-3 below. The different components of tool 104 are described in greater detail in FIGS. 4-9 below.

Figure 2:
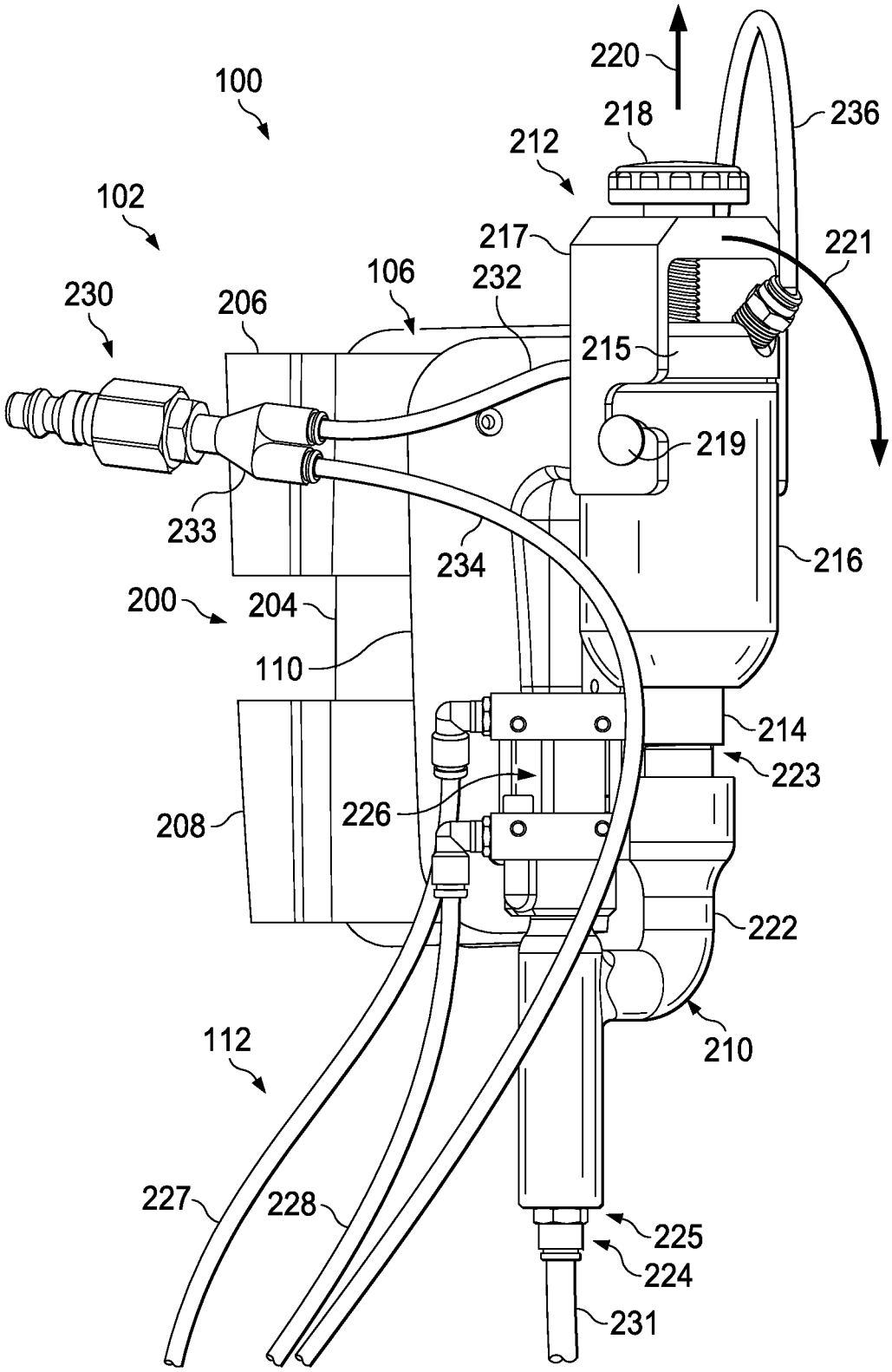
FIG. 2 is an illustration of a side view of a fluid dispensing system and a brace in accordance with an illustrative embodiment.

With reference now to FIG. 2, an illustration of a side view of fluid dispensing system 102 and brace 106 from FIG. 1 is depicted in accordance with an illustrative embodiment. In FIG. 2, a side view of fluid dispensing system 102 and brace 106 from FIG. 1 is depicted in the direction of lines 2-2 in FIG. 1. As depicted, brace 106 forms opening 200 within which the arm of a human operator may be inserted.

In this illustrative example, brace 106 includes support 204, strap 206, and strap 208. Support 204 may be placed over the arm of the human operator. Strap 206 and strap 208 may be used to secure brace 106 to the arm of the human operator.

As depicted, fluid dispensing system 102 includes control valve 210, retaining system 212, and cartridge 214. Retaining system 212 is used to hold cartridge 214. Cartridge 214 may be configured to hold a fluid, such as, for example, without limitation, a sealant material.

Retaining system 212 includes lid 215, sleeve 216, rotatable element 217, and threaded member 218. Sleeve 216 is associated with mounting plate 110 and is used to hold cartridge 214. Lid 215 is configured to form a hermetic seal with the top of cartridge 214. A hermetic seal is impervious to air or gas. In other words, a hermetic seal is airtight.

Rotatable element 217 is associated with element 219 and another element (not shown in this view) located on sleeve 216. Rotatable element 217 is configured to rotate about element 219 and this other element.

As depicted, threaded member 218 may be inserted through an opening (not shown in this view) in rotatable element 217. Threaded member 218 is used to secure the current position of rotatable element 217 relative to sleeve 216 and lid 215. Threaded member 218 prevents rotatable element 217 from being rotated about element 219 and the other element on sleeve 216. Threaded member 218 may be removed to allow rotatable element 217 to rotate. In particular, rotatable element 217 may be rotated in the direction of arrow 221 to allow removal of lid 215 and provide access to cartridge 214. Cartridge 214 may then be moved upwards in a direction substantially parallel to axis 220 away from sleeve 216. In this manner, cartridge 214 may be replaced as needed.

In this illustrative example, control valve 210 includes valve body 222, nozzle 224, and actuation device 226. Valve body 222 is a disposable valve body in this example. As depicted, valve body 222 has first end 223 and second end 225. Nozzle 224 is unitary with valve body 222 and is located at second end 225. As used herein, a first item may be "unitary" with a second item by being part of the second item. In other words, the first item and the second item may form a single unit. In this manner, nozzle 224 may be part of valve body 222.

Fluid may flow from cartridge 214 into valve body 222 at first end 223 and out of nozzle 224 at second end 225. Actuation device 226 controls the flow of fluid out of nozzle 224. Actuation device 226 is a pneumatic actuation device in this illustrative example.

For example, air may be sent into actuation device 226 through only one of air line 227 and air line 228 at a time. When air is sent into actuation device 226 through air line 227, actuation device 226 allows fluid to flow out of nozzle 224 into fluid line 231. When air is sent into actuation device 226 through air line 228, actuation device 226 is configured to stop fluid from flowing out of nozzle 224 into fluid line 231.

In this illustrative example, integrated system 100 also includes valve 230. Valve 230 may be connected to an air supply (not shown). The air supply may take the form of, for example, without limitation, an air tank. Splitter 233 may be used to allow the air provided by the air supply to flow from valve 230 into air line 232 and air line 234.

Air line 234 carries air to tool 104 in FIG. 1. Air line 232 carries air to a pressure regulator, shown in FIG. 3 below. The pressure regulator may be used to control the pressure with which air is supplied inside cartridge 214. Air line 236 may fluidly connect the pressure regulator to cartridge 214 through lid 215.

In this illustrative example, cartridge 214 may be open at the top end of cartridge 214. An object (not shown in this view), such as a piston, may be positioned within cartridge 214 on top of the fluid within cartridge 214. The piston may form an interference fit with an inner wall of cartridge 214. The piston may be movable in a direction substantially parallel to axis 220 such that the piston moves within cartridge 214.

With the piston positioned inside of cartridge 214, lid 215 may then be used to cover cartridge 214 and form a hermetic seal with cartridge 214. A space may be present between the piston and lid 215 within cartridge 214. Air line 236 may carry air from the pressure regulator to this space between the piston and lid 215 through an opening in lid 215. As air is supplied to this space by air line 236, the air volume within the space may increase. The pressure regulator, shown in FIG. 3 below, is used to control this pressure.

In this illustrative example, the air volume within this space may be increased at a substantially constant pressure to cause the piston to move downwards and displace the fluid in cartridge 214 into control valve 210. In other words, the air flowing in the space between the piston and lid 215 may cause the piston to move such that the fluid is extruded from cartridge 214.

Figure 3:
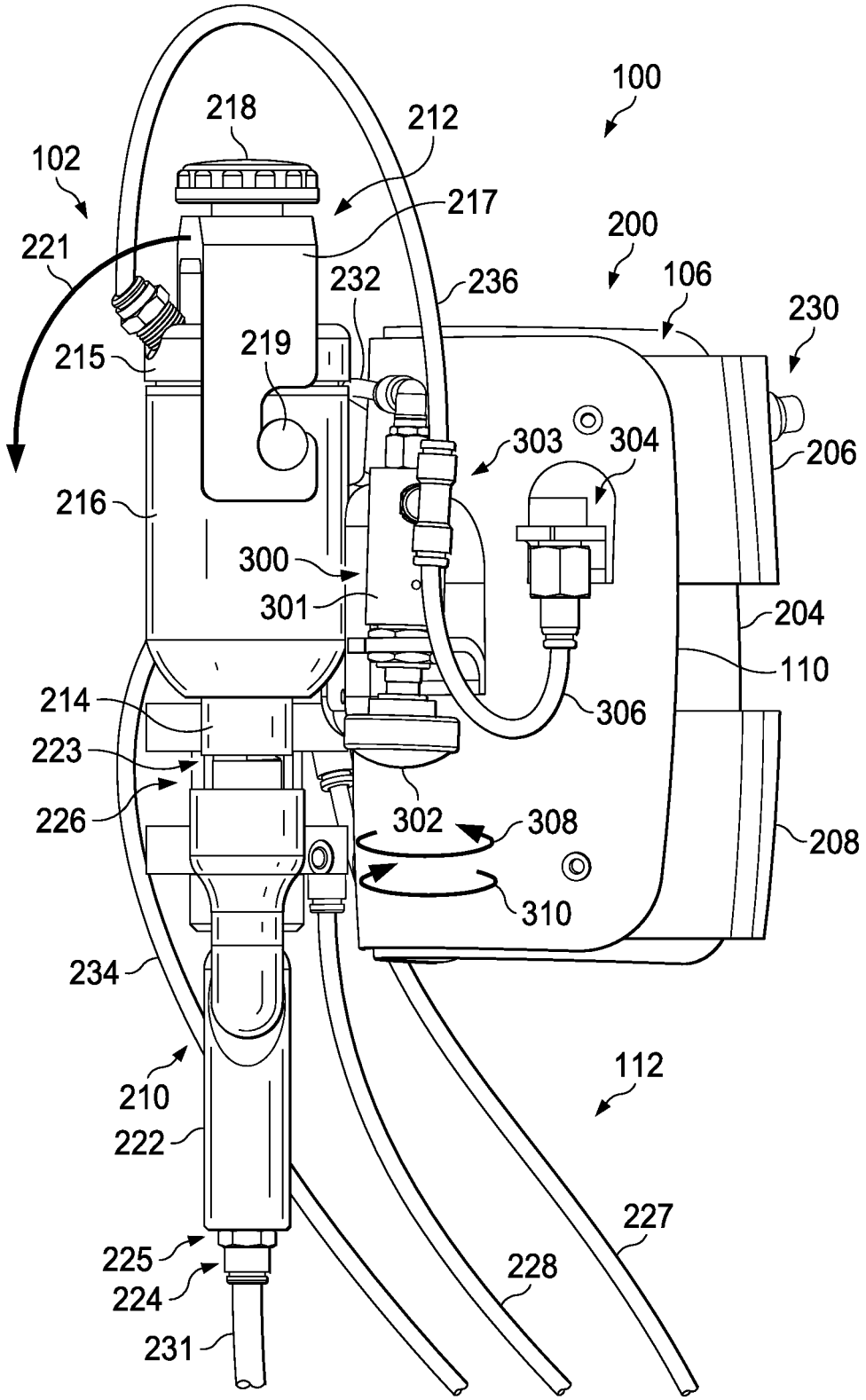
FIG. 3 is an illustration of an opposite side view of a fluid dispensing system and a brace in accordance with an illustrative embodiment.

With reference now to FIG. 3, an illustration of an opposite side view of fluid dispensing system 102 and brace 106 from FIG. 1 is depicted in accordance with an illustrative embodiment. In FIG. 3, a side view of fluid dispensing system 102 and brace 106 from FIG. 1 is depicted taken in the direction of lines 3-3 in FIG. 1.

As depicted, fluid dispensing system 102 also includes pressure regulator 300. Pressure regulator 300 includes valve 301, knob 302, connector 303, and pressure sensor device 304. Air line 232 carries air to valve 301. Air line 236 carries air from valve 301 to the space between the piston (not shown in this view) within cartridge 214 and lid 215. Air line 236 is fluidly connected to connector 303, which is fluidly connected to valve 301. Air line 306 fluidly connects connector 303 to pressure sensor device 304.

Pressure sensor device 304 is a pressure gauge that measures the pressure inside cartridge 214. Knob 302 may control operation of valve 301 and may be used to increase or decrease the pressure inside cartridge 214 in the space between the piston (not shown in this view) within cartridge 214 and lid 215.

As one illustrative example, if the pressure measured by pressure sensor device 304 is higher than desired, knob 302 may be rotated in the direction of arrow 308 to increase the pressure of the air carried from valve 301 to within cartridge 214 by air line 236. If the pressure measured by pressure sensor device 304 is lower than desired, knob 302 may be rotated in the direction of arrow 310 to decrease the pressure of the air carried from valve 301 to within cartridge 214 by air line 236.

Figure 4:
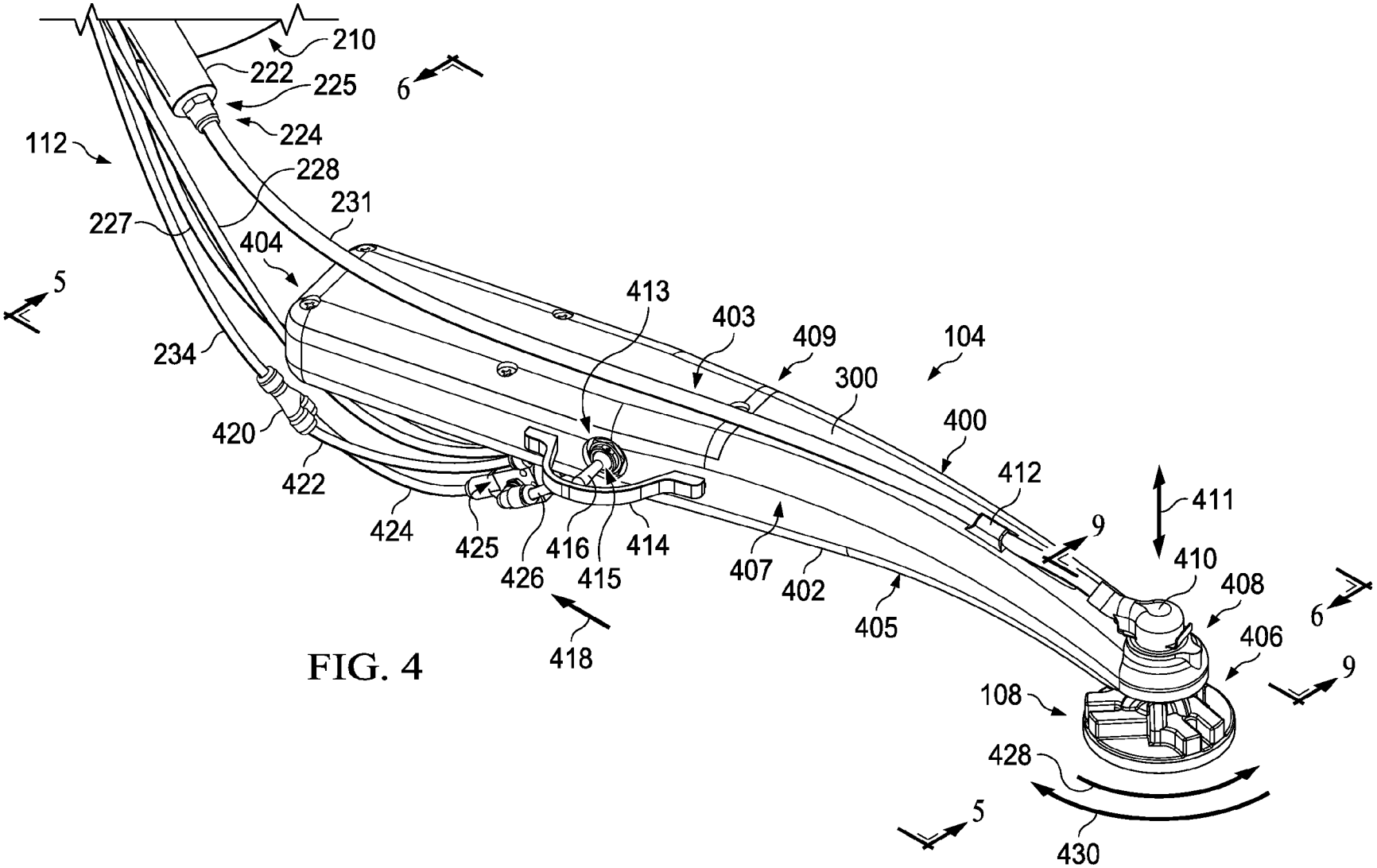
FIG. 4 is an illustration of a tool in accordance with an illustrative embodiment.

With reference now to FIG. 4, an illustration of tool 104 from FIG. 1 is depicted in accordance with an illustrative embodiment. In this illustrative example, tool 104 includes structure 400. Structure 400 may take the form of housing 402 in this illustrative example. As depicted, structure 400 has first end 404 and second end 406. Structure 400 has top 403, bottom 405, first side 407, and second side 409.

In this illustrative example, applicator 108 is associated with second end 406 of structure 400. Applicator 108 may be associated with second end 406 of structure 400 by a pulley (not shown) located within attachment portion 408 of structure 400. The pulley may allow applicator 108 to rotate about center axis 411 through applicator 108. Center axis 411 may be a Z-axis in this illustrative example.

Connector 410 is associated with attachment portion 408 and fluid line 231. Fluid may flow from fluid line 231 to applicator 108 through connector 410.

In this illustrative example, retaining element 412 located on top 403 of structure 400 is used to keep fluid line 231 in place. Retaining element 412 may prevent fluid line 231 from getting in the way of performing fluid application operations using tool 104.

Protective element 414 is associated with first side 407 of structure 400. Protective element 414 is configured to prevent undesired activation of first control device 415. First control device 415 may be part of movement system 413 of tool 104. In this illustrative example, first control device 415 takes the form of trigger 416.

A human operator may use at least one finger to apply a first force to trigger 416 in the direction of arrow 418.

Applying this first force to trigger 416 in the direction of arrow 418 may activate movement system 413 and cause movement system 413 to move applicator 108. In this illustrative example, movement system 413 may cause applicator 108 to rotate back and forth about center axis 411 in the direction of arrow 428 and arrow 430.

Movement system 413 is pneumatically operated in this illustrative example. Movement system 413 receives air from air line 234. In particular, splitter 420 splits the flow of air within air line 234 into two flows through air line 422 and air line 424.

Air line 424 carries air to air pressure regulator 425. Air line 426 also carries air to air pressure regulator 425. Air pressure regulator 425 is part of movement system 413 and is described in greater detail in FIG. 7 below. Air line 422 carries air for use by a delivery system (not shown in this view) of tool 104. The delivery system is configured to control the delivery of fluid from fluid dispensing system 102 in FIGS. 1-3 to applicator 108. Most of the components of this delivery system are located inside structure 400 and are described in greater detail in FIG. 7 below.

Figure 5:
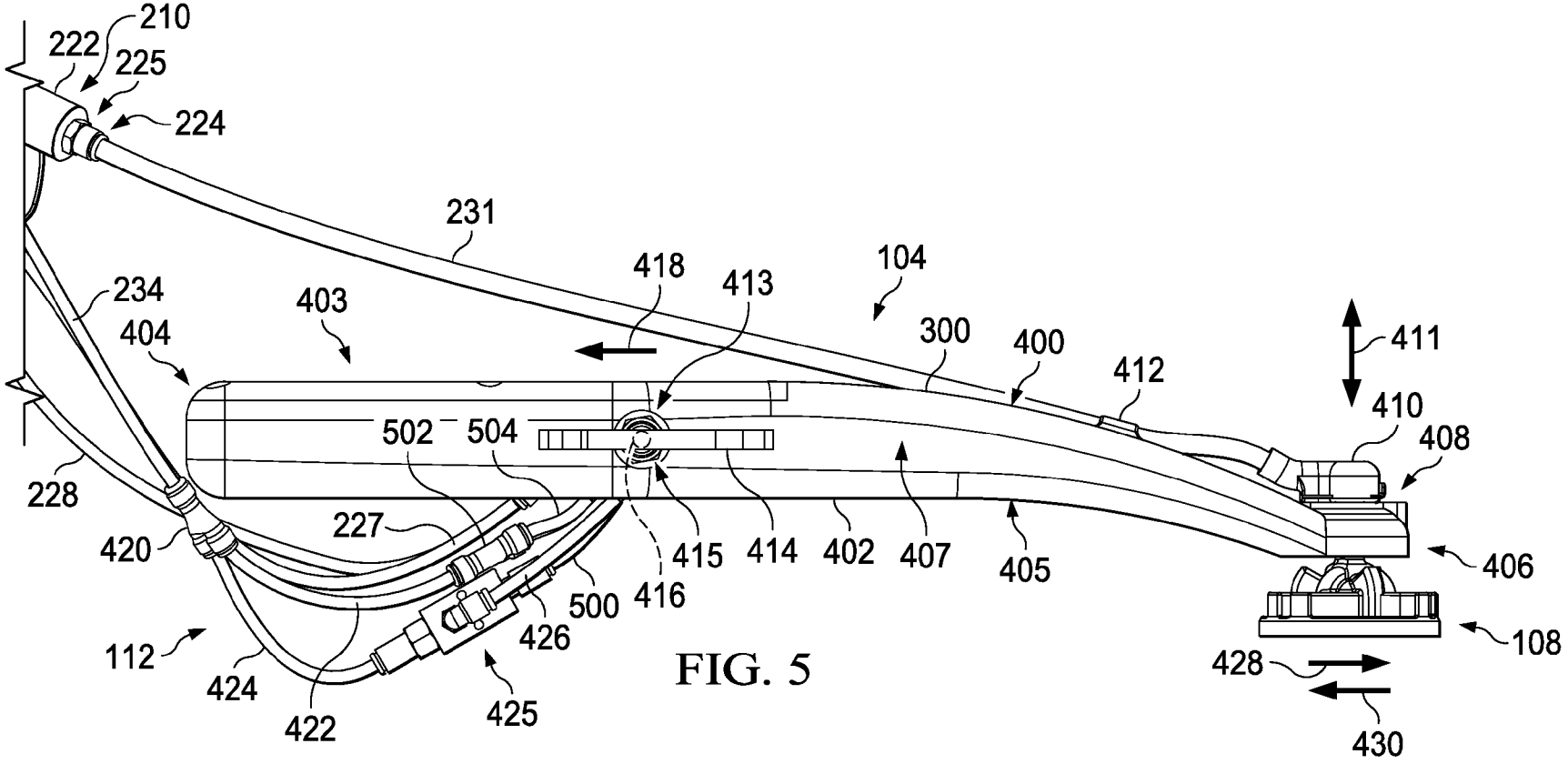
FIG. 5 is an illustration of a side view of a tool in accordance with an illustrative embodiment.

With reference now to FIG. 5, an illustration of a side view of tool 104 from FIG. 4 is depicted in accordance with an illustrative embodiment. In FIG. 5, a side view of tool 104 from FIG. 4 is depicted taken in the direction of lines 5-5 in FIG. 4. In this illustrative example, tool 104 is depicted from first side 407 of structure 400. Air line 500 may be seen in this depicted example. Air line 500 carries air from air pressure regulator 425 to a component of movement system 413 located inside of structure 400.

Further, splitter 502 is also depicted. Splitter 502 splits the flow of air within air line 422 into two flows through air line 504 and another air line (not shown in this view).

Figure 6:
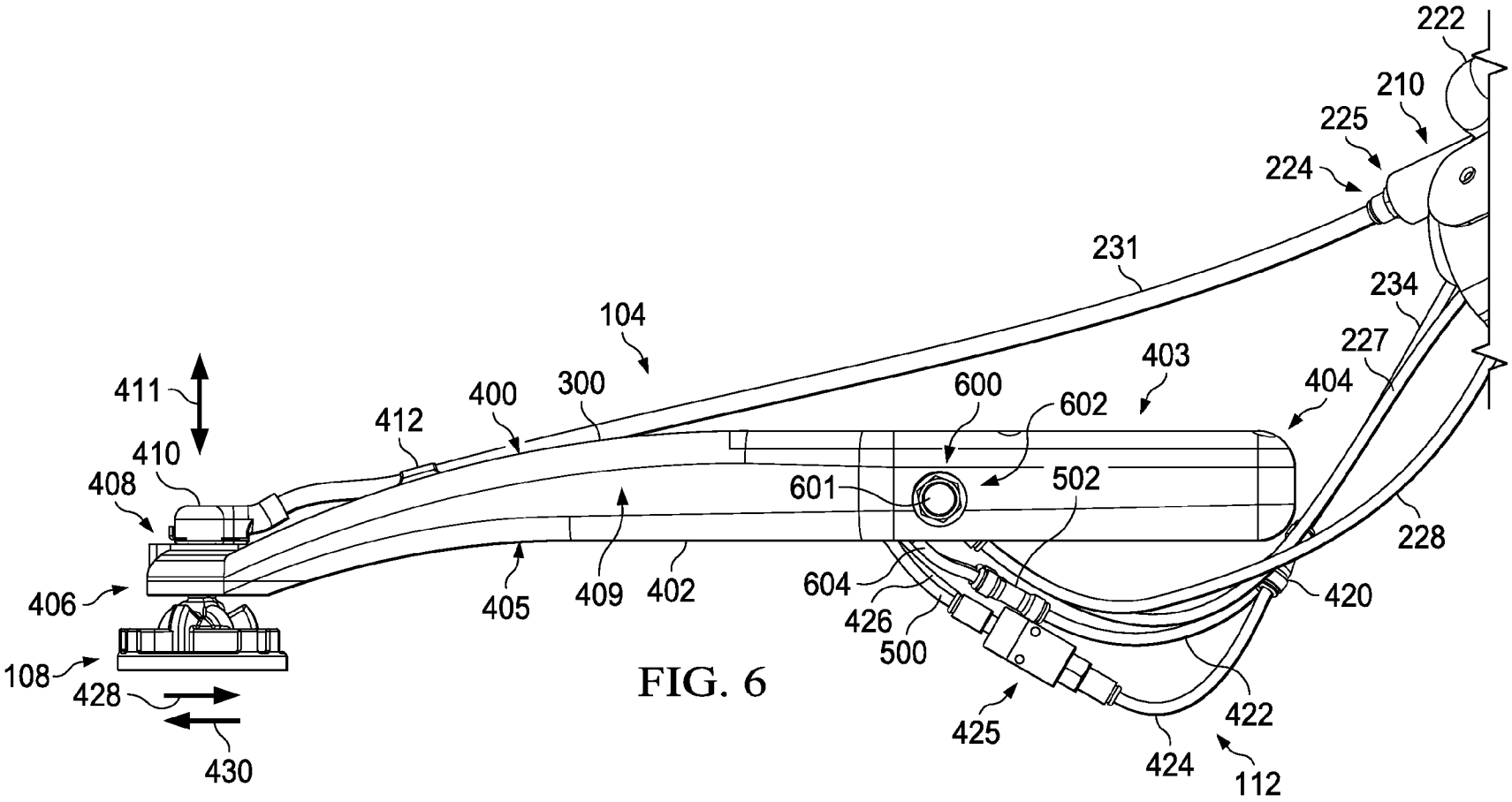
FIG. 6 is an illustration of a side view of a tool in accordance with an illustrative embodiment.

With reference now to FIG. 6, an illustration of a side view of tool 104 from FIG. 4 is depicted in accordance with an illustrative embodiment. In FIG. 6, a side view of tool 104 from FIG. 4 is depicted taken in the direction of lines 6-6 in FIG. 4. In this illustrative example, tool 104 is depicted from second side 409 of structure 400. Second control device 600 is associated with structure 400. Second control device 600 takes the form of button 601 in this illustrative example.

Button 601 is part of delivery system 602. Delivery system 602 is configured to control the delivery of fluid from fluid dispensing system 102 in FIGS. 1-3 to applicator 108.

Further, air line 604 is also seen in this view. As depicted, air line 604 receives air through splitter 502.

Figure 7:
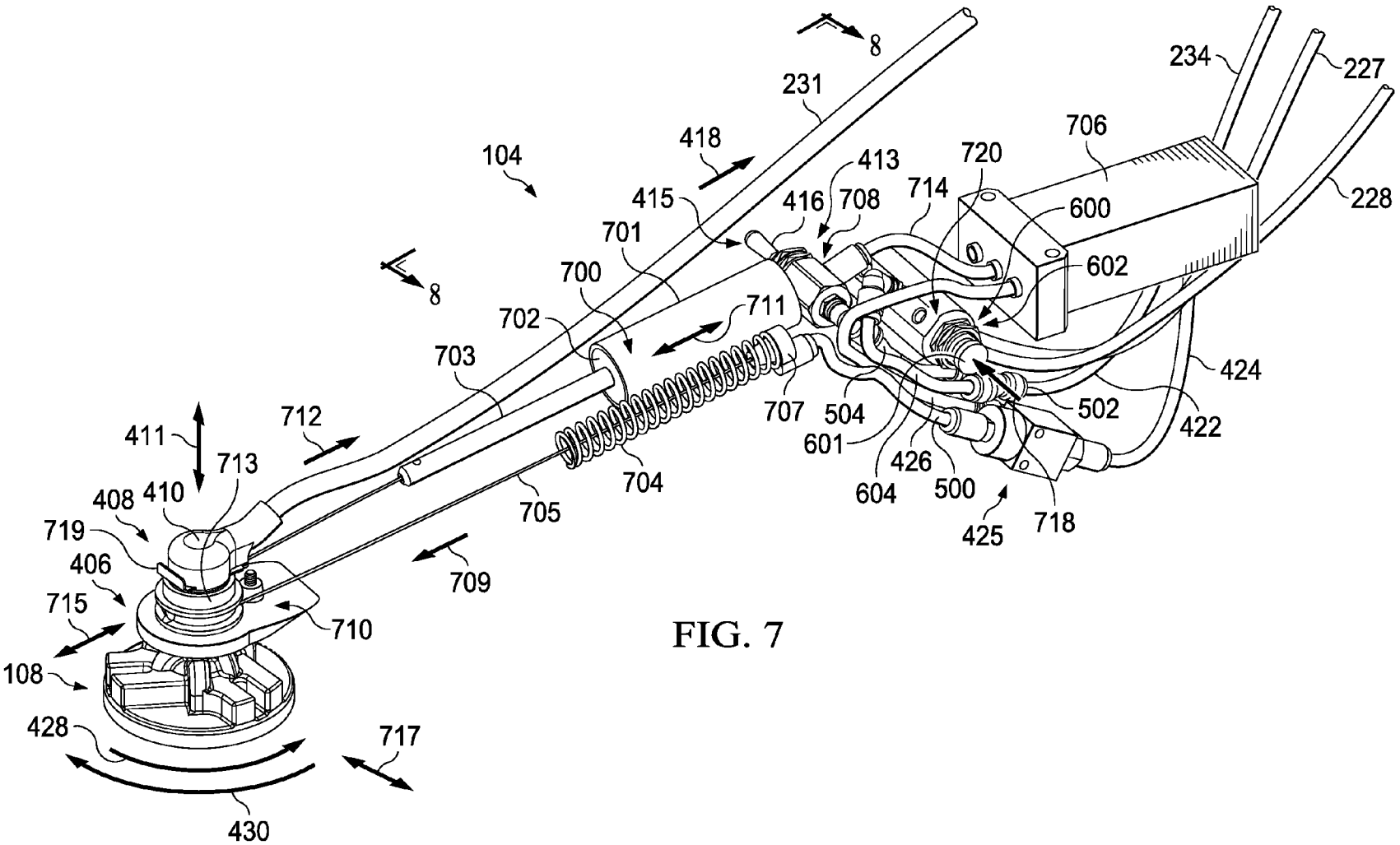
FIG. 7 is an illustration of an exposed view of a tool in accordance with an illustrative embodiment.

With reference now to FIG. 7, an illustration of an exposed view of tool 104 is depicted in accordance with an illustrative embodiment. In this illustrative example, structure 400 from FIGS. 4-6 has been removed to expose the various components located within structure 400 of tool 104.

As depicted, movement system 413 includes trigger 416, actuation device 700, pulse generator 706, valve 708, air pressure regulator 425, and pulley 710. Actuation device 700 includes piston sleeve 701, piston 702, elongate member 703, compression spring 704, cable 705, and element 707.

As depicted, piston 702 is located within piston sleeve 701. Piston 702 is configured to move in a direction along axis 711 relative to piston sleeve 701. As depicted, elongate member 703 is associated with piston 702. Cable 705 connects elongate member 703 to element 707. Element 707 is associated with compression spring 704.

Air pulses may be sent into actuation device 700 through air line 500. The air pulses may have an air pressure greater than the air pressure in the environment around tool 104. Thus, the air pulses may be referred to as compressed air pulses. The air pulses sent into actuation device 700 may be generated using pulse generator 706. The applying of a first force in the direction of arrow 418 to trigger 416 causes valve 708 to allow the flow of air received at valve 708 from air line 504 to be sent into air line 714. Air line 714 carries this air into pulse generator 706.

Pulse generator 706 uses the air to generate air pulses that are then sent through air line 426 into air pressure regulator 425. The air pulses may be sent at some selected frequency. In one illustrative example, the selected frequency may be about 150 cycles per minute. Air pressure regulator 425 may use air received through air line 424 to increase the pressure of these air pulses and send the air pulses into actuation device 700 through air line 500.

As depicted, air line 500 is associated with piston 702. When an air pulse flowing through air line 500 reaches piston 702, the air pulse applies a force against piston 702 in the direction of arrow 712 along axis 711 through piston 702. This force results in pressure being applied to piston 702. When the pressure applied to piston 702 reaches beyond a selected threshold, piston 702 may be considered pressurized.

In response to being pressurized, piston 702 moves in the direction of arrow 712 along axis 711. Movement of piston 702 in the direction of arrow 712 causes element 707 to move in the direction of arrow 709. Movement of element 707 in the direction of arrow 709 applies a load to compression spring 704 that causes compression spring 704 to compress. In other words, pressurization of piston 702 results in a load being applied on compression spring 704.

After the air pulse, the force against piston 702 that was pressurizing piston 702 is removed. Thus, piston 702 depressurizes until the next air pulse is received. Depressurization of piston 702 occurs when the pressure being applied to piston 702 is reduced beyond a selected threshold. When piston 702 depressurizes, a load is no longer applied to compression spring 704. As a result, compression spring 704 extends and causes element 707 to move in the direction opposite arrow 709. Movement of element 707 in the direction opposite arrow 709 then causes piston 702 to move back in the direction opposite arrow 712 along axis 711.

When multiple air pulses are sent into actuation device 700, piston 702 may be moved back and forth along axis 711 multiple times. This back and forth linear motion may be referred to as reciprocating motion. Pulley 710 is configured to convert this reciprocating motion into oscillating motion.

In this illustrative example, applicator 108 is associated with pulley 710. In particular, applicator 108 may be associated with pulley 710 such that applicator 108 and pulley 710 substantially share the same center axis 411. As depicted, a portion of cable 705 may be associated with pulley 710.

Movement of piston 702 in the direction of arrow 712 along axis 711 causes pulley 710 to rotate in the direction of arrow 430 about center axis 411. Rotation of pulley 710 in the direction of arrow 430 causes applicator 108 to also rotate in the direction of arrow 430 about center axis 411. Movement of piston 702 in the direction opposite arrow 712 causes pulley 710 to rotate in the direction of arrow 428 about center axis 411. Rotation of pulley 710 in the direction of arrow 428 causes applicator 108 to also rotate in the direction of arrow 428 about center axis 411.

Rotation of applicator 108 about center axis 411 may be allowed by the association of applicator 108 with connector 410. Connector 410 may have a slot within which clip 719 may be inserted. Clip 719 may be used to engage applicator 108 in a manner that allows applicator 108 to be rotatable about center axis 411.

Back and forth rotation of applicator 108 in the direction of arrow 428 and arrow 430 may be referred to as oscillating motion. Thus, pulley 710 may be used to convert the reciprocating motion of piston 702 into oscillating motion of applicator 108.

As depicted, applicator 108 may be associated with gimbal device 713 through pulley 710. Gimbal device 713 may be located within pulley 710. Gimbal device 713 may be configured to provide at least one rotational degree of freedom to applicator 108. In this illustrative example, gimbal device 713 may provide two rotational degrees of freedom.

In particular, gimbal device 713 may allow applicator 108 to rotate about roll axis 715 up to some selected threshold. Roll axis 715 may be a Y-axis in this illustrative example. For example, gimbal device 713 may allow applicator 108 to rotate about roll axis 715 up to about 6 degrees. Further, gimbal device 713 may allow applicator 108 to rotate about pitch axis 717 up to some selected threshold. Pitch axis 717 may be an X-axis in this illustrative example. For example, gimbal device 713 may allow applicator 108 to rotate about pitch axis 717 up to about 6 degrees.

In this manner, gimbal device 713 may allow applicator 108 to rotate to accommodate different angles on different surfaces. For example, applicator 108 may rotate about roll axis 715, pitch axis 717, or both to maintain contact with uneven surfaces, curved surfaces, and surfaces having other types of inconsistencies.

In this illustrative example, the various components of delivery system 602 may also be seen. As depicted, delivery system 602 includes button 601 and valve 720. Valve 720 receives air through air line 604. Valve 720 allows air received through air line 604 to flow into one of air line 227 and air line 228.

When a second force is applied to button 601 in the direction of arrow 718, valve 720 only allows air to flow into air line 227. The flow of air into air line 227 controls actuation device 226 in FIG. 2 such that fluid is allowed to flow out of nozzle 224 in FIG. 2 into fluid line 231. When button 601 is released, valve 720 only allows air to flow into air line 228. The flow of air into air line 228 controls actuation device 226 in FIG. 2 such that fluid is stopped from flowing out nozzle 224 in FIG. 2 into fluid line 231. In this manner, button 601 is used to control the delivery of fluid from fluid dispensing system 102 in FIGS. 1-2 to applicator 108.

Figure 8:
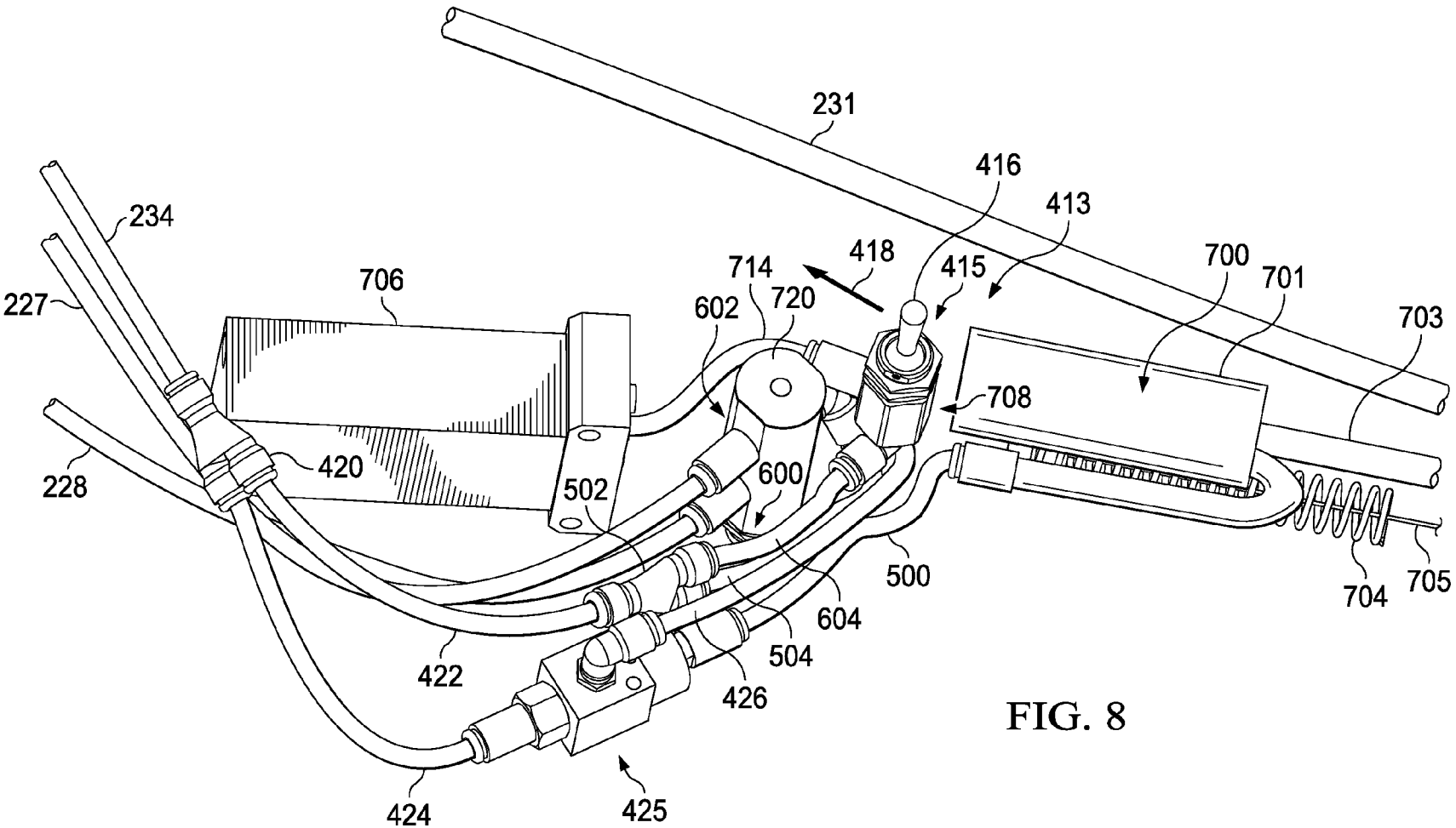
FIG. 8 is an illustration of an enlarged view of a portion of an exposed view of a tool in accordance with an illustrative embodiment.

With reference now to FIG. 8, an illustration of an enlarged view of a portion of an exposed view of tool 104 from FIG. 7 is depicted in accordance with an illustrative embodiment. In particular, an enlarged view of a portion of the exposed view of tool 104 from FIG. 7 is depicted taken in the direction of lines 8-8 in FIG. 7. Some of the air lines carrying air to the different components of delivery system 602 and movement system 413 may be more clearly seen.

Figure 9:
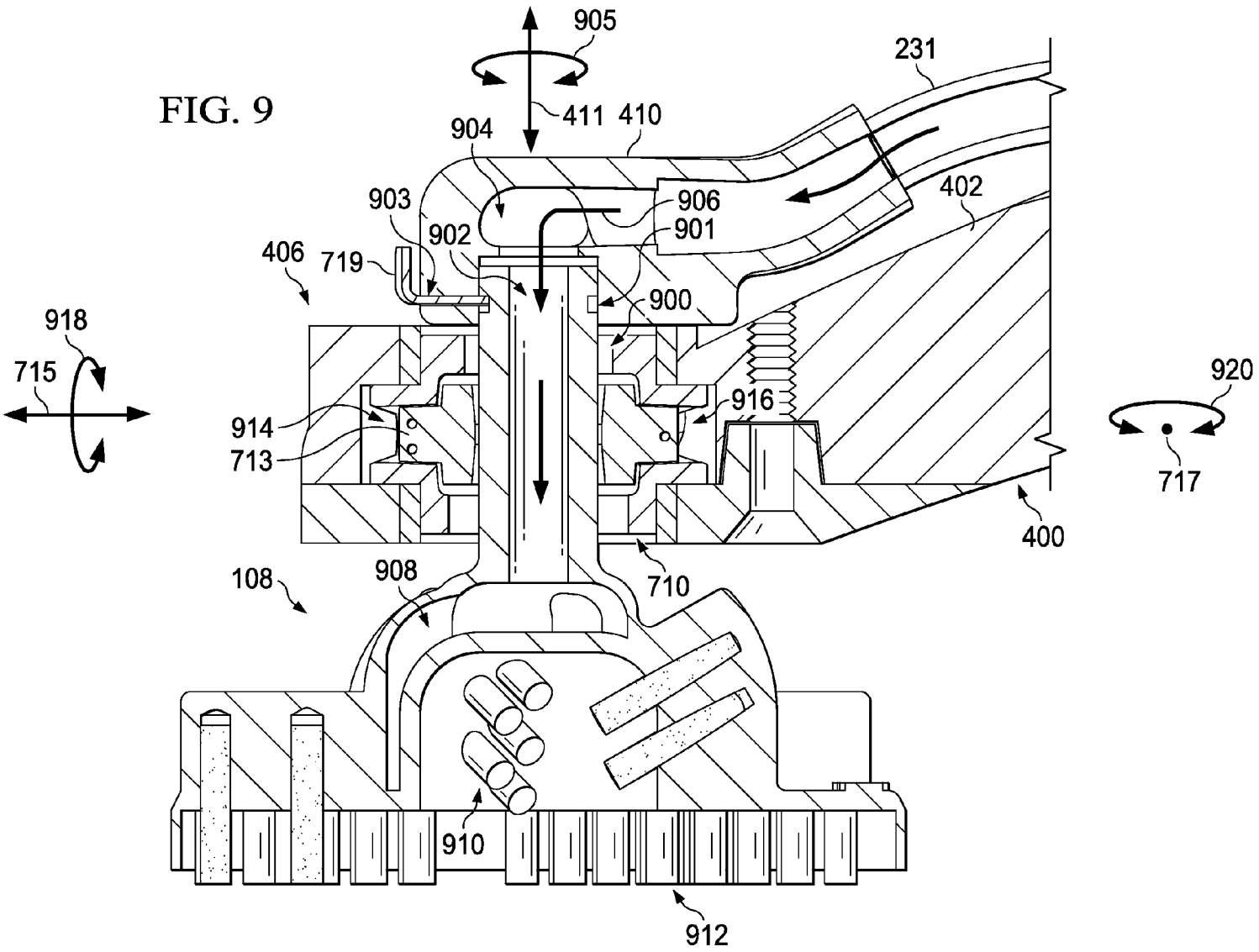
FIG. 9 is an illustration of a cross-sectional view of an attachment portion of a structure and an applicator in accordance with an illustrative embodiment.

With reference now to FIG. 9, an illustration of a cross-sectional view of attachment portion 408 of structure 400 and applicator 108 from FIGS. 4-7 is depicted in accordance with an illustrative embodiment. In this illustrative example, a cross-sectional view of attachment portion 408 of structure 400 and applicator 108 from FIGS. 4-7 is taken in the direction of lines 9-9 in FIG. 4.

As depicted, applicator 108 may have stem 900. Stem 900 may be associated with connector 410 through clip 719. Stem 900 has groove 901. Clip 719 is inserted through slot 903 of connector 410 such that clip 719 may engage groove 901 of stem 900. Clip 719 allows stem 900, and thus, applicator 108, to be rotatable about center axis 411 in the direction of arrow 905. Clip 719 may be slid out of slot 903 to allot detachment of applicator 108 from connector 410.

Stem 900 may have channel 902 configured to receive fluid through connector 410. In particular, connector 410 may have cavity 904 configured to receive fluid from fluid line 231. The fluid may travel through fluid line 231, through cavity 904, and through channel 902 of stem 900 in the direction of arrow 906. In this manner, cavity 904 and channel 902 may be fluidly connected when clip 719 is used to engage stem 900 of applicator 108 to connect applicator 108 to connector 410.

The fluid may flow through channel 902 of stem 900 into plurality of channels 908. Fluid may flow out of plurality of channels 908 such that the fluid contacts first plurality of bristles 910 and second plurality of bristles 912. As depicted, first plurality of bristles 910 may be angled relative to center axis 411. Second plurality of bristles 912 may be substantially parallel to center axis 411. In this manner, applicator 108 may be used to more completely apply the fluid onto a surface comprised of various angles or an uneven surface.

When used to apply a fluid, such as a sealant material, onto the exposed ends of fasteners, first plurality of bristles 910 may be oriented for applying the sealant material onto the sides of the exposed ends of the fasteners. Second plurality of bristles 912 may be oriented for applying the sealant material onto the portion of the surface surrounding the exposed ends of the fasteners.

As depicted in this example, gimbal device 713 may engage opening 914 and opening 916 of pulley 710. Opening 914 and opening 916 of pulley 710 may be configured such that gimbal device 713 may be rotatable about roll axis 715 in the direction of arrow 918.

Further, stem 900 may have pins (not shown in this view) located on stem 900 configured to engage grooves (not shown in this view) on the inside of gimbal device 713. These grooves and pins may allow stem 900, and thereby applicator 108, to be rotatable about pitch axis 717 in the direction of arrow 920.

Figure 10:
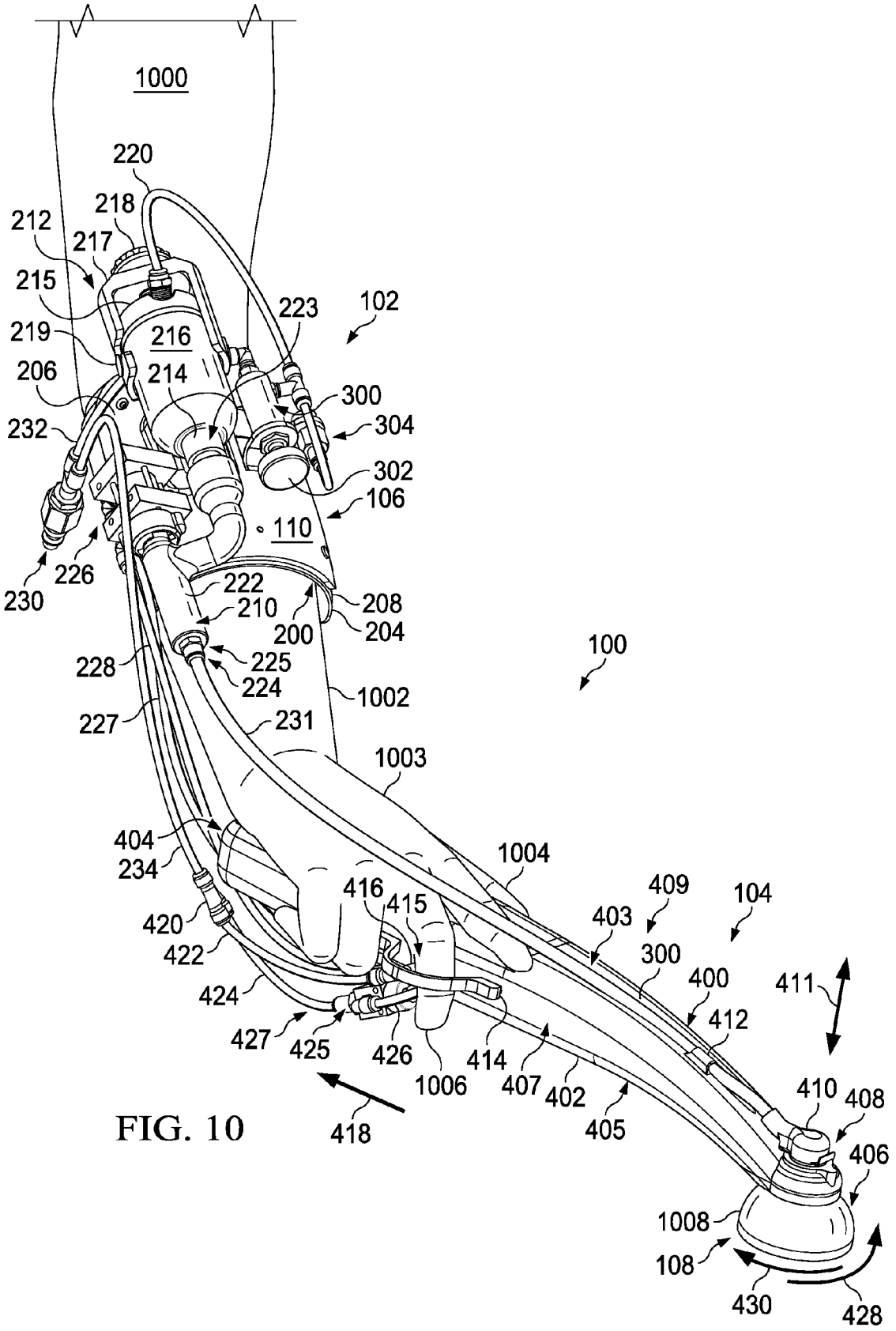
FIG. 10 is an illustration of an integrated system in accordance with an illustrative embodiment.

With reference now to FIG. 10, an illustration of integrated system 100 from FIGS. 1-9 being operated by a human operator is depicted in accordance with an illustrative embodiment. In this illustrative example, arm 1000 is the arm of a human operator.

In this illustrative example, brace 106 is worn around forearm 1002 of arm 1000. Further, the human operator is holding tool 104 by gripping structure 400 of tool 104 close to first end 404 of structure 400 using hand 1003.

The human operator may use thumb 1004 of hand 1003 to push button 601 (not shown in this view) from FIG. 6. The human operator may use finger 1006 of hand 1003 to control trigger 416.

In this illustrative example, applicator 108 from FIG. 1 is covered using cover 1008. Cover 1008 may have a size and shape configured such that applicator 108 with cover 1008 may be placed over the exposed end of a fastener to completely cover the exposed end. Cover 1008 may help prevent fluid from spraying in undesired locations during the application of fluid over the exposed end of the fastener.

Figure 11:
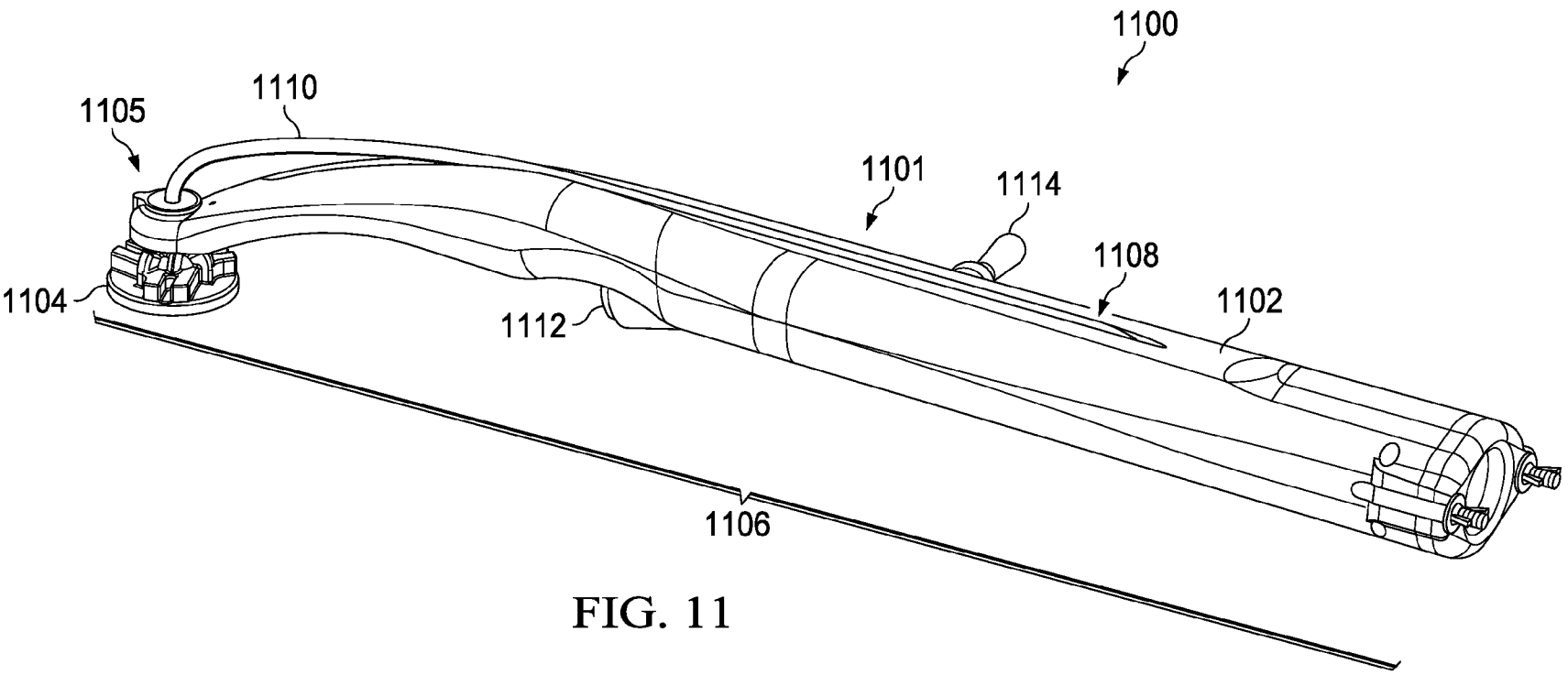
FIG. 11 is an illustration of a different type of integrated system in accordance with an illustrative embodiment.

With reference now to FIG. 11, an illustration of a different type of integrated system is depicted in accordance with an illustrative embodiment. In this illustrative example, integrated system 1100 has tool 1101 and a fluid dispensing system (not shown in this view). Tool 1101 has structure 1102 with applicator 1104 attached to attachment portion 1105 of structure 1102.

Structure 1102 is longer than structure 400 of tool 104 in FIG. 1. In particular, structure 1102 has length 1106. Length 1106 of structure 1102 allows the fluid dispensing system (not shown) of integrated system 1100 to be incorporated inside structure 1102.

Structure 1102 has opening 1108 from which fluid line 1110 comes out of structure 1102. Fluid line 1110 is associated with attachment portion 1105 of structure 1102 and allows fluid to be delivered to applicator 1104.

A human operator may use button 1112 to control the delivery of fluid to applicator 1104. The human operator may use trigger 1114 to control the movement of applicator 1104.

Figure 12:
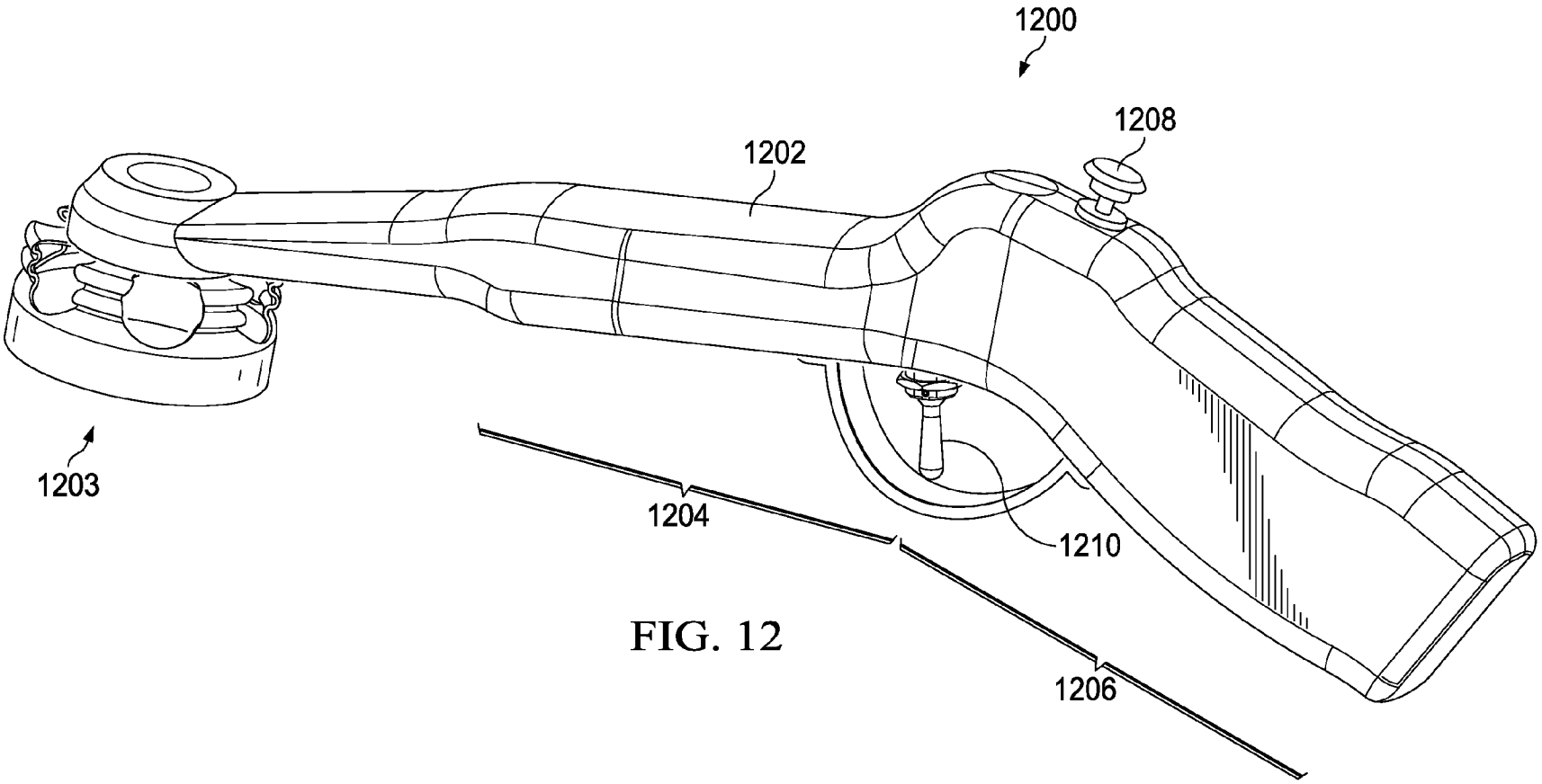
FIG. 12 is an illustration of a different type of tool in accordance with an illustrative embodiment.

With reference now to FIG. 12, an illustration of a different type of tool is depicted in accordance with an illustrative embodiment. In this illustrative example, tool 1200 is an example of a different configuration for the tool in an integrated system, such as integrated system 100 in FIG. 1. In this illustrative example, tool 1200 has structure 1202 and applicator 1203 associated with structure 1202.

Structure 1202 has first portion 1204 and second portion 1206. First portion 1204 may be angled relative to second portion 1206. The angling of first portion 1204 relative to second portion 1206 may allow applicator 1203 to reach hard-to-reach locations, such as around corners. A human operator may use button 1208 to control the delivery of fluid to applicator 1203 and trigger 1210 to control the movement of applicator 1203.

The illustrations of integrated system 100 in FIGS. 1-10, fluid dispensing system 102 and brace 106 in FIGS. 2-3, tool 104 in FIGS. 4-9, integrated system 1100 in FIG. 11, and tool 1200 in FIG. 12 are not meant to imply physical or architectural limitations to the manner in which an illustrative embodiment may be implemented. Other components in addition to or in place of the ones illustrated may be used. Some components may be optional.

The different components shown in FIGS. 1-12 may be illustrative examples of how components shown in block form in FIG. 13 below can be implemented as physical structures. Additionally, some of the components in FIGS. 1-12 may be combined with components in FIG. 13, used with components in FIG. 13, or a combination of the two.

Figure 13:
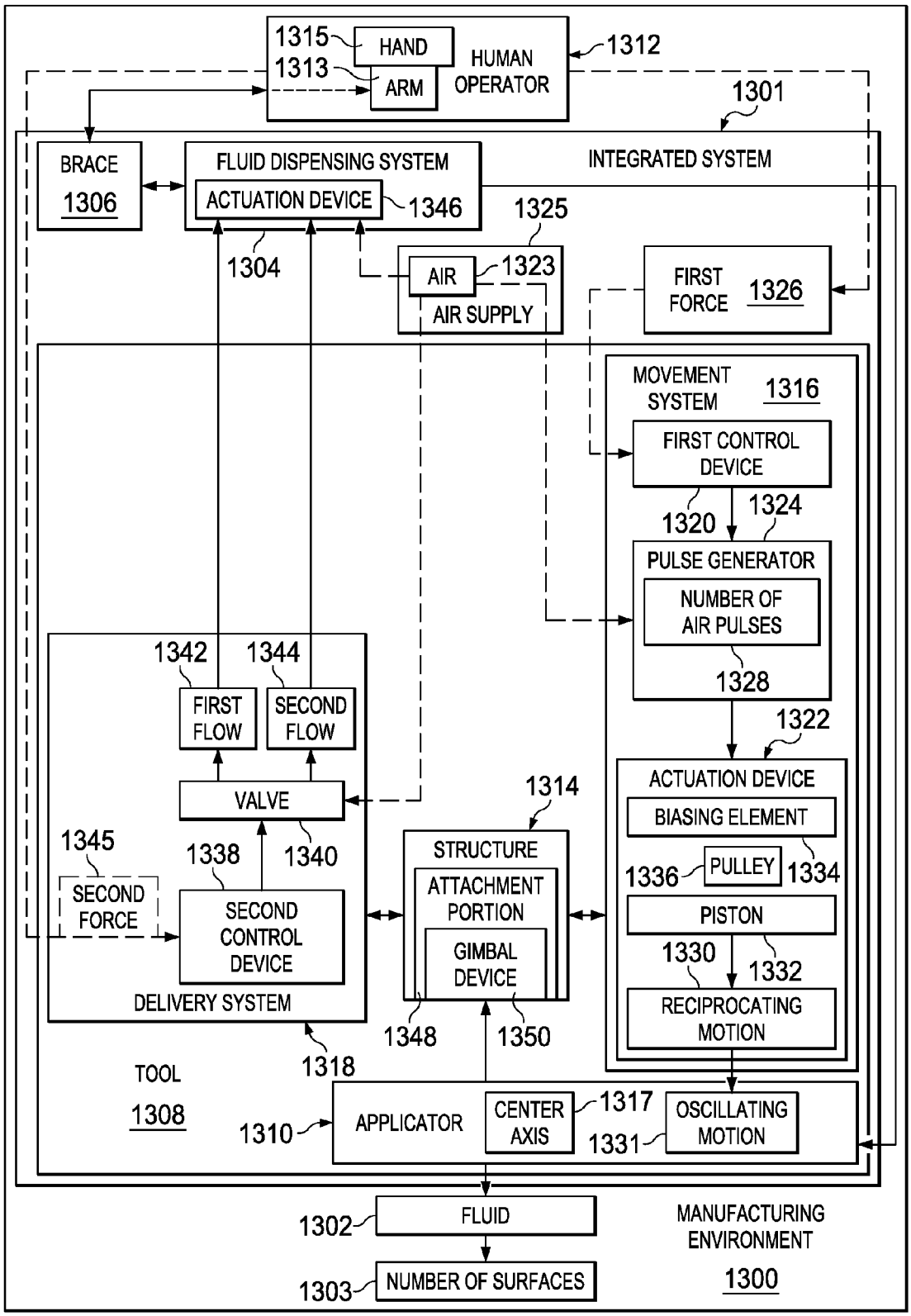
FIG. 13 is an illustration of a manufacturing environment in the form of a block diagram in accordance with an illustrative embodiment.

Turning now to FIG. 13, an illustration of a manufacturing environment is depicted in the form of a block diagram in accordance with an illustrative embodiment. In this illustrative example, manufacturing environment 1300 may be an example of an environment in which integrated system 1301 may be used to apply fluid 1302 onto number of surfaces 1303. As used herein, a "number of" items may include one or more items. In this manner, number of surfaces 1303 may include one or more surfaces.

Fluid 1302 may take a number of different forms. In one illustrative example, fluid 1302 may be a high-viscosity fluid. In particular, fluid 1302 may have a viscosity above about 5000 centipoise. For example, fluid 1302 may take the form of a sealant material.

Integrated system 100 in FIG. 1 may be an example of one implementation for integrated system 1301. In this illustrative example, integrated system 1301 includes fluid dispensing system 1304, brace 1306, tool 1308, and applicator 1310. Fluid dispensing system 102, brace 106, tool 104, and applicator 108 in FIG. 1 are examples of implementations for fluid dispensing system 1304, brace 1306, tool 1308, and applicator 1310, respectively.

In one illustrative example, fluid dispensing system 1304 may be associated with brace 1306. Brace 1306 may allow human operator 1312 to wear fluid dispensing system 1304. In particular, brace 1306 may be configured to be worn around arm 1313 of human operator 1312. Tool 1308 may be configured to be held by human operator 1312. In this illustrative example, hand 1315 may be used to hold tool 1308.

In this illustrative example, applicator 1310 is associated with tool 1308. Applicator 1310 is considered part of tool 1308 in this example. However, in other examples, applicator 1310 may be considered separate from tool 1308. Applicator 1310 is used to apply fluid 1302 onto number of surfaces 1303. Applicator 1310 may take a number of different forms. In one illustrative example, applicator 1310 may take the form of a brush having a plurality of bristles for use in applying fluid 1302 onto number of surfaces 1303. In this manner, applicator 1310 may be used to brush a coat of fluid 1302 onto number of surfaces 1303.

As depicted, tool 1308 may include structure 1314, movement system 1316, and delivery system 1318. Structure 400, movement system 413, and delivery system 602 in FIG. 6 may be examples of implementations for structure 1314, movement system 1316, and delivery system 1318.

Structure 1314 may have attachment portion 1348. Applicator 1310 may be associated with attachment portion 1348 of structure 1314. Movement system 1316 is used to move applicator 1310 relative to structure 1314. As depicted, movement system 1316 may include first control device 1320, actuation device 1322, and pulse generator 1324.

First force 1326 may be applied to first control device 1320 by an operator, such as human operator 1312. In one illustrative example, first control device 1320 may take the form of a trigger. First force 1326 may be applied to first control device 1320 by pulling the trigger.

In this illustrative example, applying first force 1326 to first control device 1320 causes applicator 1310 to move relative to center axis 1317 of applicator 1310. Center axis 1317 is a vertical axis that passes through the horizontal center of applicator 1310 in this illustrative example.

In this illustrative example, actuation device 1322 causes movement of applicator 1310 in responses to first force 1326 being applied to first control device 1320. Actuation device 1322 may be a pneumatic actuation device.

Actuation device 1322 may receive number of air pulses 1328 from pulse generator 1324. Pulse generator 1324 is configured to receive air 1323 and send number of air pulses 1328 into actuation device 1322. Air 1323 may be received from air supply 1325. Pulse generator 1324 may be configured to send number of air pulses 1328 into actuation device 1322 at a selected frequency. Depending on the implementation, the frequency may be selected to prevent undesired splatter of fluid 1302 during application of fluid 1302, to ensure an even application of fluid 1302, or some combination thereof.

In one illustrative example, actuation device 1322 is configured to create reciprocating motion 1330 in response to receiving number of air pulses 1328 from pulse generator 1324. In this manner, actuation device 1322 may create reciprocating motion 1330 in response to first force 1326 being applied to first control device 1320. Further, actuation device 1322 is configured to convert reciprocating motion 1330 into oscillating motion 1331 of applicator 1310.

As depicted, actuation device 1322 includes piston 1332, biasing element 1334, and pulley 1336. Piston 1332 is configured to be pressurized by number of air pulses 1328 such that piston 1332 moves in a first linear direction along a center axis through piston 1332. Biasing element 1334 is configured to move piston 1332 in a second linear direction opposite the first linear direction in response to depressurization of the piston. Thus, in response to receiving multiple air pulses, piston 1332 moves back and forth linearly. This type of back and forth motion may be referred to as reciprocating motion 1330. Thus, piston 1332 is configured to reciprocate in response to first force 1326 being applied to first control device 1320.

Pulley 1336 may be associated with piston 1332 and biasing element 1334 by a cable. Pulley 1336 may also be associated with applicator 1310. Pulley 1336 may cause applicator 1310 to rotate in a first direction about center axis 1317 through applicator 1310 in response to piston 1332 moving in the first linear direction. Further, pulley 1336 may cause applicator 1310 to rotate in a second direction about center axis 1317 through applicator 1310 in response to piston 1332 moving in the second linear direction. In response to multiple air pulses being received at actuation device 1322, applicator 1310 may rotate back and forth to form oscillating motion 1331.

In this illustrative example, delivery system 1318 is used to deliver fluid 1302 from fluid dispensing system 1304 to applicator 1310. As depicted, delivery system 1318 includes second control device 1338 and valve 1340. Valve 1340 receives air 1323 from air supply 1325. Valve 1340 allows only one of first flow 1342 of air 1323 or second flow 1344 of air 1323 to actuation device 1346 in fluid dispensing system 1304 at any given time. Actuation device 1346 may be a pneumatic actuation device.

First flow 1342 of air 1323 may cause actuation device 1346 to allow the flow of fluid 1302 from fluid dispensing system 1304 to applicator 1310. Second flow 1344 of air 1323 may cause actuation device 1346 to stop fluid 1302 from flowing out of fluid dispensing system 1304 to applicator 1310. The particular flow allowed by valve 1340 is controlled by second control device 1338.

When no force is applied to second control device 1338, valve 1340 allows second flow 1344 of air 1323. Applying second force 1345 to second control device 1338 causes valve 1340 to stop second flow 1344 of air 1323 and allow first flow 1342 of air 1323 to actuation device 1346. Thus, the absence of any force being applied to second control device 1338 prevents fluid 1302 from flowing to applicator 1310 from fluid dispensing system 1304. Applying second force 1345 to second control device 1338 results in fluid 1302 flowing from fluid dispensing system 1304 to applicator 1310.

In one illustrative example, second control device 1338 takes the form of a button. In this example, second force 1345 may be applied to the button by an operator, such as human operator 1312, by pushing the button.

Applicator 1310 may be associated with attachment portion 1348 of structure 1314 in a manner such that applicator 1310 may have at least one rotational degree of freedom. As described above, applicator 1310 may be rotatable about center axis 1317 of applicator 1310. This type of rotation may be referred to as yaw and center axis 1317 may be referred to as a yaw axis.

In some illustrative examples, applicator 1310 may have two additional rotational degrees of freedom. For example, without limitation, applicator 1310 may be associated with attachment portion 1348 through gimbal device 1350. Gimbal device 1350 may provide applicator 1310 with the two additional rotational degrees of freedom.

In particular, gimbal device 1350 may allow applicator 1310 to rotate about a pitch axis and a roll axis through applicator 1310, both of which are substantially perpendicular to center axis 1317. However, depending on the implementation, rotation of applicator 1310 may be limited up to a selected range of degrees about the pitch axis, about the roll axis, or about both. Being able to rotate about the pitch axis and the roll axis may allow applicator 1310 to maintain at least a minimum desired level contact with number of surfaces 1303 even when number of surfaces 1303 is uneven or has different angles.

As described above, integrated system 1301 may be implemented using only pneumatically-operated devices. Using pneumatically-operated devices may allow different types of fluids to be dispensed and applied with a reduced risk of undesired effects occurring. For example, using pneumatically-operated devices may allow flammable liquids to be used.

The illustration of manufacturing environment 1300 and integrated system 1301 in FIG. 1 is not meant to imply physical or architectural limitations to the manner in which an illustrative embodiment may be implemented. Other components in addition to or in place of the ones illustrated may be used. Some components may be optional. Also, the blocks are presented to illustrate some functional components. One or more of these blocks may be combined, divided, or combined and divided into different blocks when implemented in an illustrative embodiment.

For example, in some cases, movement of piston 1332 in the first linear direction causes movement of applicator 1310 in the first linear direction. Movement of piston 1332 in the second linear direction causes movement of applicator 1310 in the second linear direction. Thus, reciprocating motion 1330 of piston 1332 may not be converted into oscillating motion 1331 of applicator 1310 but into a similar reciprocating motion of applicator 1310.

In some illustrative examples, a level of second force 1345 applied to second control device 1338 may determine the rate of flow of fluid 1302 from fluid dispensing system 1304. Increasing the level of second force 1345 being applied to second control device 1338 may increase the rate of flow of fluid 1302 from fluid dispensing system 1304 to applicator 1310.

Figure 14:
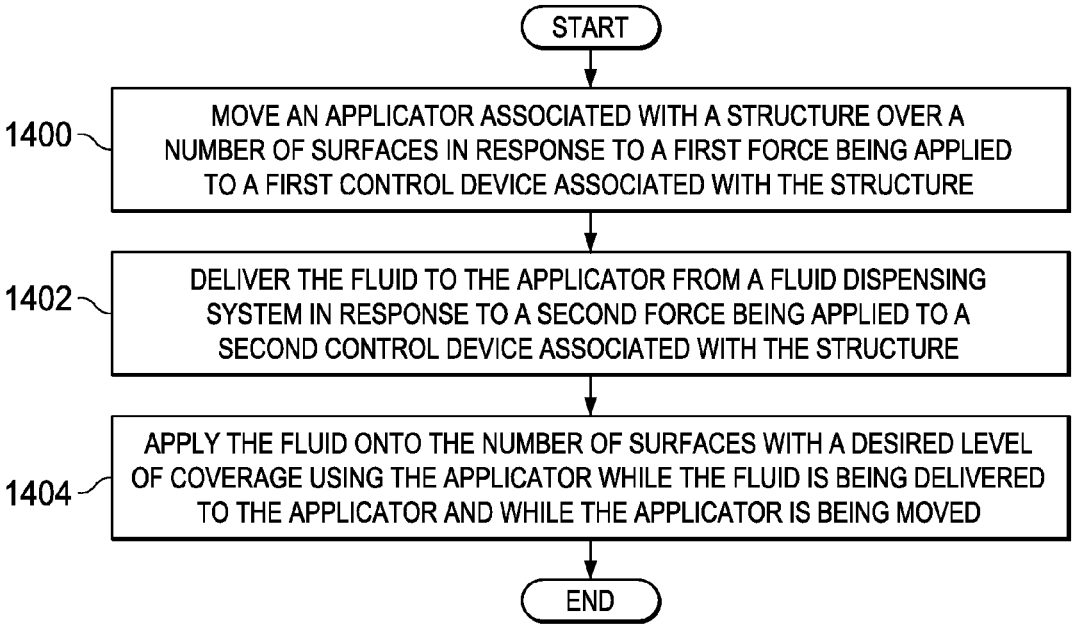
FIG. 14 is an illustration of a process for applying a fluid onto a number of surfaces in the form of a flowchart in accordance with an illustrative embodiment.

With reference now to FIG. 14, an illustration of a process for applying a fluid onto a number of surfaces is depicted in the form of a flowchart in accordance with an illustrative embodiment. The process illustrated in FIG. 14 may be implemented using an integrated system, such as integrated system 1301 in FIG. 1. In one illustrative example, the process illustrated in FIG. 14 may be implemented using integrated system 100 described in FIGS. 1-10.

The process may begin by moving an applicator associated with a structure over a number of surfaces in response to a first force being applied to a first control device associated with the structure (operation 1400). In operation 1400, the applicator may be moved in an oscillating manner. In one illustrative example, the first control device may take the form of a trigger and the first force being applied to the trigger may result in oscillating motion of the applicator.

Next, the fluid is delivered to the applicator from a fluid dispensing system in response to a second force being applied to a second control device associated with the structure (operation 1402). In one illustrative example, the second control device may take the form of a button. In this example, the application of the second force to the button may result in the fluid being delivered from the fluid dispensing system to the applicator at a controlled rate in operation 1402.

Thereafter, the fluid may be applied onto the number of surfaces with a desired level of coverage using the applicator while the fluid is being delivered to the applicator and while the applicator is being moved (operation 1404), with the process terminating thereafter. In operation 1404, the simultaneous delivery of fluid to the applicator and oscillating motion of the applicator may ensure that the desired level of coverage over the number of surfaces is achieved.

Figure 15:
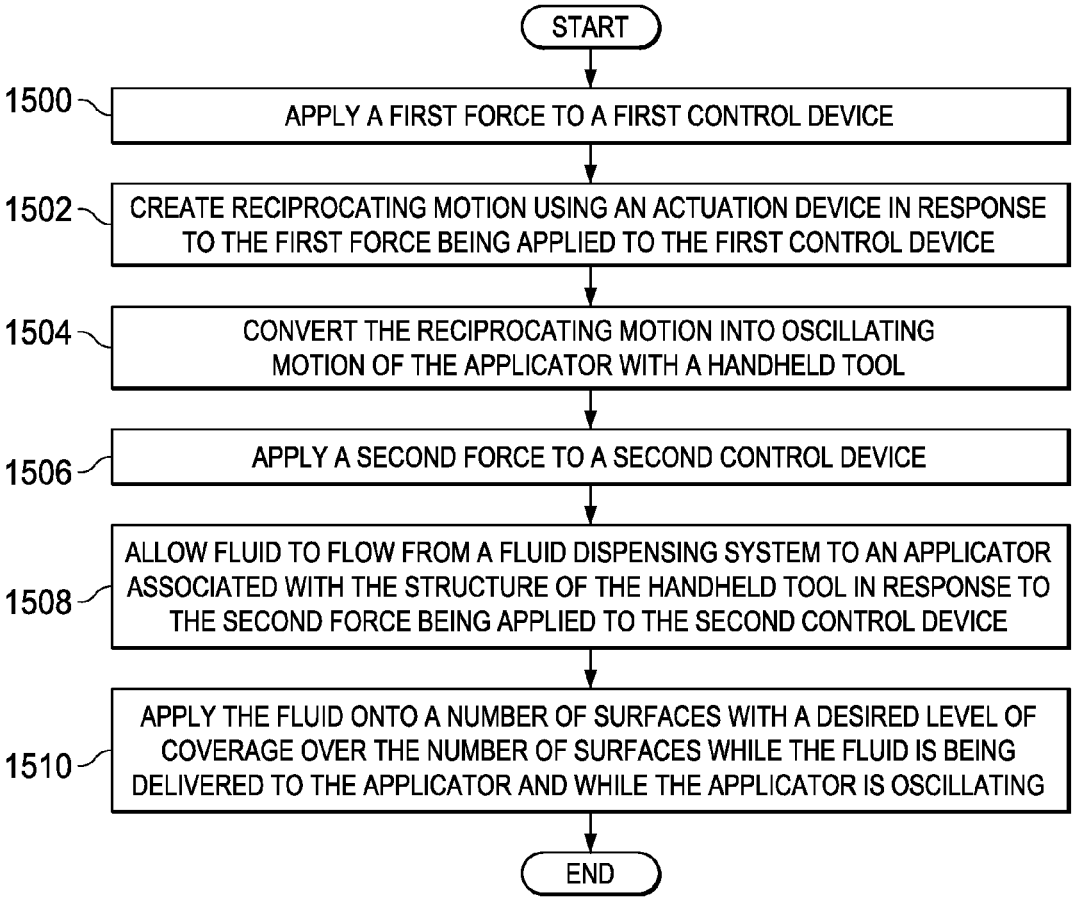
FIG. 15 is an illustration of a process for applying a fluid onto a number of surfaces in the form of a flowchart in accordance with an illustrative embodiment.

With reference now to FIG. 15, an illustration of a process for applying a fluid onto a number of surfaces is depicted in the form of a flowchart in accordance with an illustrative embodiment. The process illustrated in FIG. 15 may be implemented using an integrated system, such as integrated system 1301 in FIG. 1. In one illustrative example, the process illustrated in FIG. 15 may be implemented using integrated system 100 described in FIGS. 1-10.

The process may begin by applying a first force to a first control device (operation 1500). Next, reciprocating motion is created using an actuation device in response to the first force being applied to the first control device (1502). The reciprocating motion is then converted into oscillating motion of an applicator associated with a handheld tool (operation 1504).

A second force is applied to a second control device (operation 1506). Fluid is allowed to flow from a fluid dispensing system to an applicator associated with the structure of the handheld tool in response to the second force being applied to the second control device (operation 1508).

The fluid is then applied onto a number of surfaces with a desired level of coverage over the number of surfaces while the fluid is being delivered to the applicator and while the applicator is oscillating (operation 1510), with the process terminating thereafter. During operation 1510, the delivery of the fluid to the applicator while the applicator oscillates may ensure a substantially even coverage of the number of surfaces.

Figure 16:
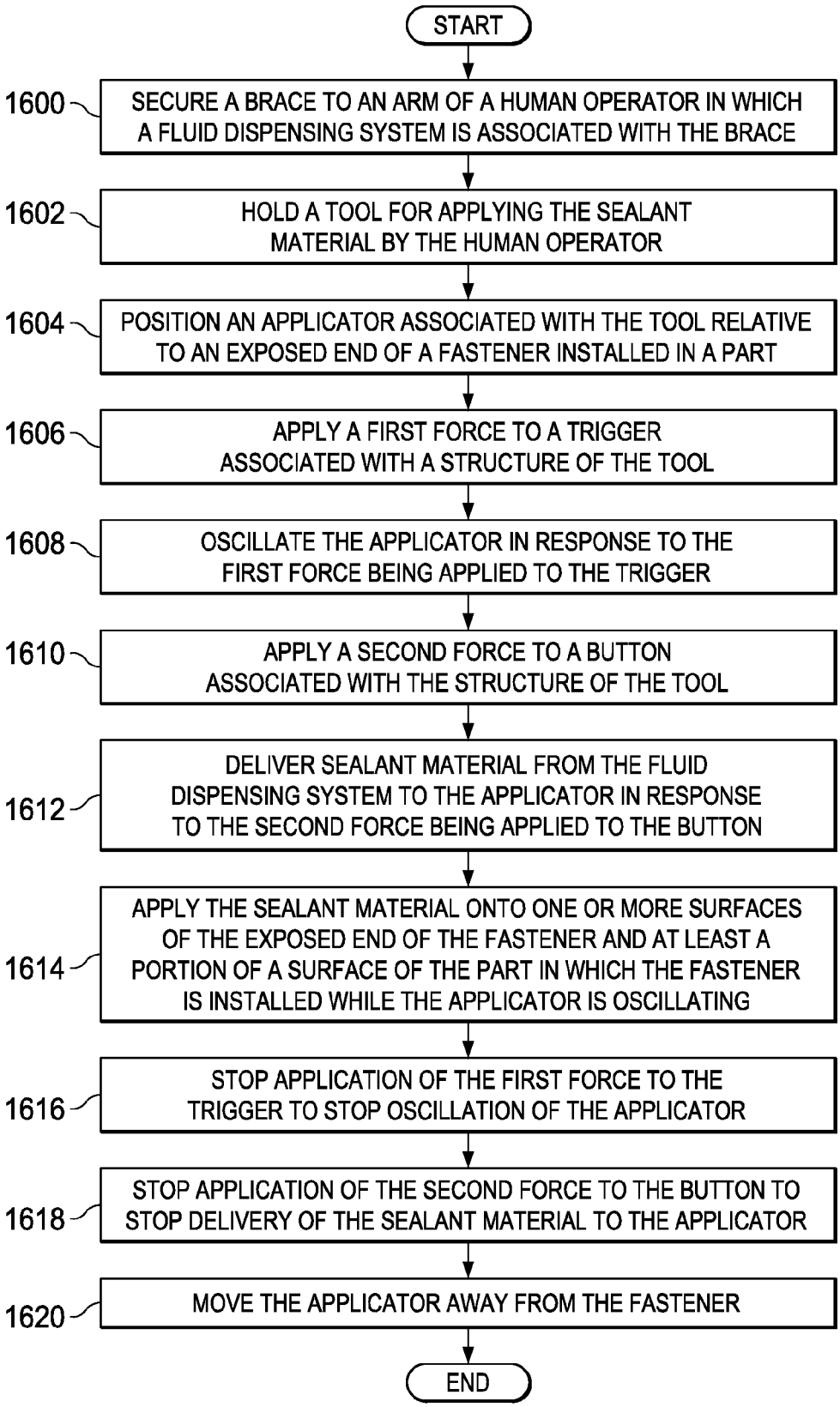
FIG. 16 is an illustration of a process for applying a sealant material onto an exposed end of a fastener installed in a part in the form of a flowchart in accordance with an illustrative embodiment.

With reference now to FIG. 16, an illustration of a process for applying a sealant material onto an exposed end of a fastener installed in a part is depicted in the form of a flowchart in accordance with an illustrative embodiment. The process illustrated in FIG. 16 may be implemented using, for example, integrated system 100 described in FIGS. 1-10 or integrated system 1301 described in FIG. 13.

The process begins by securing a brace to an arm of a human operator in which a fluid dispensing system is associated with the brace (operation 1600). Next, a tool for applying the sealant material is held by the human operator 1602). An applicator associated with the tool is then positioned relative to an exposed end of a fastener installed in a part (operation 1604). The part may be, for example, without limitation, a part for an aircraft.

A first force is applied to a trigger associated with a structure of the tool (operation 1606). The applicator is oscillated in response to the first force being applied to the trigger (operation 1608). A second force is applied to a button associated with the structure of the tool (operation 1610). Sealant material is delivered from the fluid dispensing system to the applicator in response to the second force being applied to the button (operation 1612).

The sealant material is applied onto one or more surfaces of the exposed end of the fastener and at least a portion of a surface of the part in which the fastener is installed while the applicator is oscillating (operation 1614). Application of the first force to the trigger is stopped to stop oscillation of the applicator (operation 1616). Application of the second force to the button is stopped to stop delivery of the sealant material to the applicator (operation 1618). The applicator is moved away from the fastener (operation 1620), with the process terminating thereafter.

The flowcharts and block diagrams in the different depicted embodiments illustrate the architecture, functionality, and operation of some possible implementations of apparatuses and methods in an illustrative embodiment. In this regard, each block in the flowcharts or block diagrams may represent a module, a segment, a function, a portion of an operation or step, some combination thereof.

In some alternative implementations of an illustrative embodiment, the function or functions noted in the blocks may occur out of the order noted in the figures. For example, in some cases, two blocks shown in succession may be executed substantially concurrently, or the blocks may sometimes be performed in the reverse order, depending upon the functionality involved. Also, other blocks may be added in addition to the illustrated blocks in a flowchart or block diagram.

For example, operation 1610 and operation 1612 may be performed simultaneously with operation 1606 and operation 1608, respectively. In another illustrative example, operation 1610 and operation 1612 may be performed before operation 1606 and operation 1608 are performed.

In one illustrative example, the second force applied to the button in operation 1612 may only be applied for a short period of time, while the first force applied to the trigger in operation 1606 may be continuously applied until application of the sealant material over the fastener has been completed.

Figure 17:
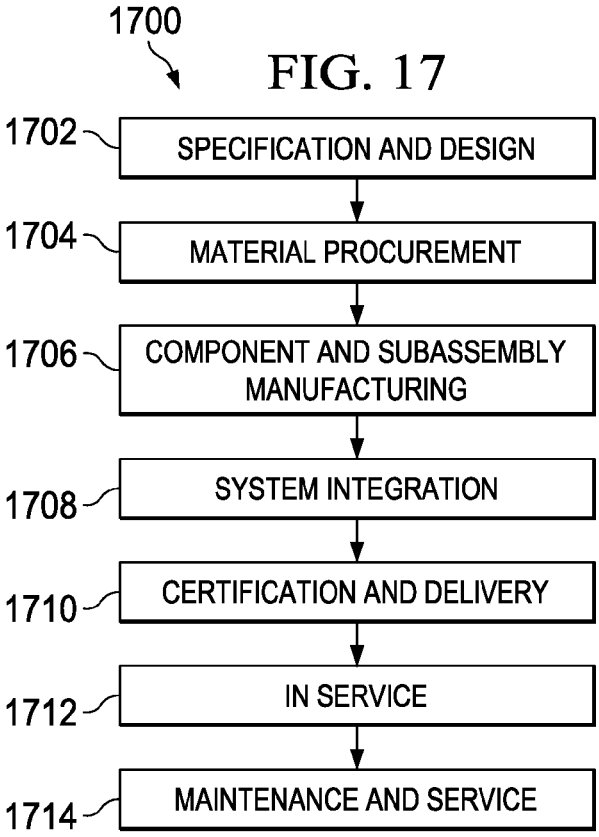
FIG. 17 is an illustration of an aircraft manufacturing and service method in the form of a block diagram in accordance with an illustrative embodiment.
Figure 18:
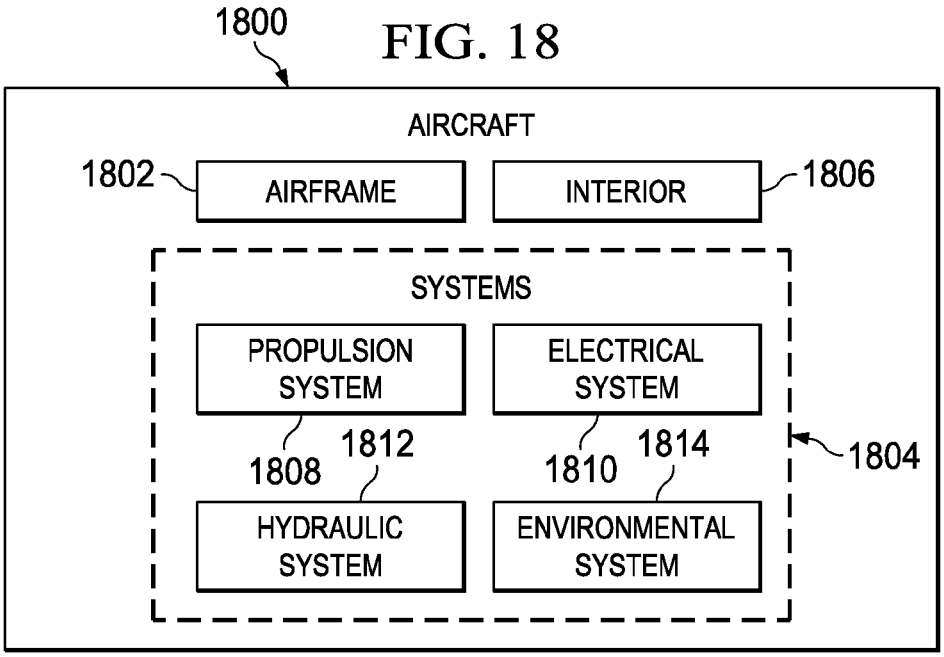
FIG. 18 is an illustration of an aircraft in the form of a block diagram in which an illustrative embodiment may be implemented.

Illustrative embodiments of the disclosure may be described in the context of aircraft manufacturing and service method 1700 as shown in FIG. 17 and aircraft 1800 as shown in FIG. 18. Turning first to FIG. 17, an illustration of an aircraft manufacturing and service method is depicted in the form of a block diagram in accordance with an illustrative embodiment. During pre-production, aircraft manufacturing and service method 1700 may include specification and design 1702 of aircraft 1800 in FIG. 18 and material procurement 1704.

During production, component and subassembly manufacturing 1706 and system integration 1708 of aircraft 1800 in FIG. 18 takes place. Thereafter, aircraft 1800 in FIG. 18 may go through certification and delivery 1710 in order to be placed in service 1712. While in service 1712 by a customer, aircraft 1800 in FIG. 18 is scheduled for routine maintenance and service 1714, which may include modification, reconfiguration, refurbishment, and other maintenance or service.

Each of the processes of aircraft manufacturing and service method 1700 may be performed or carried out by at least one of a system integrator, a third party, or an operator. In these examples, the operator may be a customer. For the purposes of this description, a system integrator may include, without limitation, any number of aircraft manufacturers and major-system subcontractors; a third party may include, without limitation, any number of vendors, subcontractors, and suppliers; and an operator may be an airline, a leasing company, a military entity, a service organization, and so on.

With reference now to FIG. 18, an illustration of an aircraft is depicted in the form of a block diagram in which an illustrative embodiment may be implemented. In this example, aircraft 1800 is produced by aircraft manufacturing and service method 1700 in FIG. 17 and may include airframe 1802 with plurality of systems 1804 and interior 1806. Examples of systems 1804 include one or more of propulsion system 1808, electrical system 1810, hydraulic system 1812, and environmental system 1814. Any number of other systems may be included. Although an aerospace example is shown, different illustrative embodiments may be applied to other industries, such as the automotive industry.

Apparatuses and methods embodied herein may be employed during at least one of the stages of aircraft manufacturing and service method 1700 in FIG. 17. In particular, integrated system 1301 from FIG. 13 may be used to apply a fluid onto one more surfaces during any one of the stages of aircraft manufacturing and service method 1700. For example, without limitation, integrated system 1301 from FIG. 13 may be used to apply sealant material onto the exposed ends of fasteners installed in parts during at least one of component and subassembly manufacturing 1706, system integration 1708, routine maintenance and service 1714, or some other stage of aircraft manufacturing and service method 1700.

In one illustrative example, components or subassemblies produced in component and subassembly manufacturing 1706 in FIG. 17 may be fabricated or manufactured in a manner similar to components or subassemblies produced while aircraft 1800 is in service 1712 in FIG. 17. As yet another example, one or more apparatus embodiments, method embodiments, or a combination thereof may be utilized during production stages, such as component and subassembly manufacturing 1706 and system integration 1708 in FIG. 17. One or more apparatus embodiments, method embodiments, or a combination thereof may be utilized while aircraft 1800 is in service 1712, during maintenance and service 1714 in FIG. 17, or both. The use of a number of the different illustrative embodiments may substantially expedite the assembly of and reduce the cost of aircraft 1800.

The flowcharts and block diagrams in the different depicted embodiments illustrate the architecture, functionality, and operation of some possible implementations of apparatuses and methods in an illustrative embodiment. In this regard, each block in the flowcharts or block diagrams may represent a module, a segment, a function, a portion of an operation or step, some combination thereof.

In some alternative implementations of an illustrative embodiment, the function or functions noted in the blocks may occur out of the order noted in the figures. For example, in some cases, two blocks shown in succession may be executed substantially concurrently, or the blocks may sometimes be performed in the reverse order, depending upon the functionality involved. Also, other blocks may be added in addition to the illustrated blocks in a flowchart or block diagram.

Thus, the illustrative embodiments provide a method and apparatus for applying a fluid onto various surfaces. By integrating the operations of dispensing a fluid and applying a fluid, integrated system 1301 from FIG. 13 may reduce the overall time and effort needed to apply the fluid. Integrated system 1301 may allow fluid to be applied to surfaces with reduced effort by a human operator.

In one illustrative embodiment, integrated system 1301 includes, but is not limited to, brace 1306, fluid dispensing system 1304, and tool 1308. Brace 1306 is configured to be worn around arm 1313 of human operator 1312. Fluid dispensing system 1304 is associated with brace 1306 and is configured to dispense fluid 1302. Fluid 1302 may be a high-viscosity fluid such as, for example, a sealant material.

Tool 1308 of integrated system 1301 is configured to be held by human operator 1312 and includes structure 1314, applicator 1310, movement system 1316, and delivery system 1318. Applicator 1310 is associated with an end of structure 1314. Structure 1314 may have a shape that allows the end of structure 1314 with applicator 1310 to reach a desired location within an area. The desired location may be within a hard-to-reach area, such as within a confined space or space not readily accessible.

Movement system 1316 is associated with structure 1314 and configured to move applicator 1310 relative to center axis 1317 of applicator 1310 in response to first force 1326 being applied to first control device 1320 in movement system 1316. Delivery system 1318 is associated with structure 1314 and configured to deliver fluid 1302 from fluid dispensing system 1304 to applicator 1310 in response to second force 1345 being applied to second control device 1338 in delivery system 1318. Thus, fluid 1302 may be applied onto a surface while fluid 1302 is being delivered to applicator 1310 and applicator 1310 is being moved over the surface.

The description of the different illustrative embodiments has been presented for purposes of illustration and description, and is not intended to be exhaustive or limited to the embodiments in the form disclosed. Many modifications and variations will be apparent to those of ordinary skill in the art. Further, different illustrative embodiments may provide different features as compared to other desirable embodiments. The embodiment or embodiments selected are chosen and described in order to best explain the principles of the embodiments, the practical application, and to enable others of ordinary skill in the art to understand the disclosure for various embodiments with various modifications as are suited to the particular use contemplated.

What is claimed is:

1. An apparatus comprising:

a structure;

an applicator associated with the structure;

a first control device associated with the structure, wherein applying a first force to the first control device causes the applicator to move relative to a center axis of the applicator;

an actuation device configured to create reciprocating motion in response to the first force being applied to the first control device; and a second control device associated with the structure, wherein applying a second force to the second control device causes a fluid to be delivered from a fluid dispensing system to the applicator.

2. The apparatus of claim 1 further comprising:

a pulse generator configured to receive air and send a number of air pulses into the actuation device to create the reciprocating motion in response to the first force being applied to the first control device.

3. The apparatus of claim 2, wherein the actuation device comprises:

a piston configured to be pressurized by an air pulse in the number of air pulses such that the piston moves in a first linear direction; and a biasing element configured to move the piston in a second linear direction opposite the first linear direction in response to depressurization of the piston.

4. The apparatus of claim 3, wherein movement of the piston in the first linear direction causes movement of the applicator in the first linear direction and wherein movement of the piston in the second linear direction causes movement of the applicator in the second linear direction.

5. The apparatus of claim 4, wherein the actuation device further comprises:

a pulley associated with the piston and the biasing element by a cable and associated with the applicator, wherein the pulley causes the applicator to rotate in a first direction about the center axis through the applicator in response to the piston moving in the first linear direction and the applicator to rotate in a second direction about the center axis through the applicator in response to the piston moving in the second linear direction.

6. The apparatus of claim 1 further comprising:

the fluid dispensing system, wherein the fluid dispensing system is configured to dispense a high-viscosity fluid for delivery to the applicator.

7. The apparatus of claim 6 further comprising:

a valve configured to control a flow of the fluid from the fluid dispensing system to the applicator, wherein applying the second force to the second control device causes the valve to allow the fluid to flow out of a nozzle of the fluid dispensing system and wherein an absence of any force being applied to the second control device prevents the fluid from flowing out of the nozzle.

8. The apparatus of claim 6, wherein increasing a level of the second force being applied to the second control device increases a rate of flow of the fluid from the fluid dispensing system.

9. The apparatus of claim 1 further comprising:

a gimbal device configured to connect the applicator to the structure and configured to allow the applicator to have at least one rotational degree of freedom.

10. The apparatus of claim 1, wherein the structure is configured to be held by a human operator and has a shape configured to allow an end of the structure with which the applicator is associated to reach a desired location within an area.

11. An integrated system comprising:

a brace configured to be worn around an arm of a human operator;

a fluid dispensing system associated with the brace and configured to dispense a fluid; and a tool configured to be held by the human operator, wherein the tool comprises:

a structure having a shape configured to allow an end of the structure to reach a desired location within an area;

an applicator associated with the end of the structure;

a movement system associated with the structure and configured to move the applicator relative to a center axis of the applicator in response to a first force being applied to a first control device in the movement system; and a delivery system associated with the structure and configured to deliver the fluid from the fluid dispensing system to the applicator in response to a second force being applied to a second control device in the delivery system.

12. The integrated system of claim 11 further comprising:

an actuation device configured to create reciprocating motion in response to the first force being applied to the first control device.

13. The integrated system of claim 12 further comprising:

a pulse generator configured to receive air and send a number of air pulses into the actuation device to create the reciprocating motion in response to the first force being applied to the first control device.

14. The integrated system of claim 13, wherein the actuation device comprises:

a piston configured to be pressurized by an air pulse in the number of air pulses such that the piston moves in a first linear direction; and a biasing element configured to move the piston in a second linear direction opposite the first linear direction in response to depressurization of the piston.

15. The integrated system of claim 14, wherein movement of the piston in the first linear direction causes movement of the applicator in the first linear direction and wherein movement of the piston in the second linear direction causes movement of the applicator in the second linear direction.

16. The integrated system of claim 15, wherein the actuation device further comprises:

a pulley associated with the piston and the biasing element by a cable and associated with the applicator, wherein the pulley causes the applicator to rotate in a first direction about the center axis through the applicator in response to the piston moving in the first linear direction and the applicator to rotate in a second direction about the center axis through the applicator in response to the piston moving in the second linear direction.

17. The integrated system of claim 11 further comprising:

the fluid dispensing system, wherein the fluid dispensing system is configured to dispense a high-viscosity fluid for delivery to the applicator.

18. The integrated system of claim 17 further comprising:

a valve configured to control a flow of the fluid from the fluid dispensing system to the applicator, wherein applying the second force to the second control device causes the valve to allow the fluid to flow out of a nozzle of the fluid dispensing system and wherein an absence of any force being applied to the second control device prevents the fluid from flowing out of the nozzle.

19. The integrated system of claim 18, wherein increasing a level of the second force being applied to the second control device increases a rate of flow of the fluid from the fluid dispensing system.

20. An apparatus comprising:

a structure;

an applicator associated with the structure;

a first control device associated with the structure, wherein applying a first force to the first control device causes the applicator to move relative to a center axis of the applicator;

a fluid dispensing system, wherein the fluid dispensing system is configured to dispense a high-viscosity fluid for delivery to the applicator;

a second control device associated with the structure, wherein applying a second force to the second control device causes the high-viscosity fluid to be delivered from the fluid dispensing system to the applicator; and a valve configured to control a flow of the fluid from the fluid dispensing system to the applicator, wherein applying the second force to the second control device causes the valve to allow the fluid to flow out of a nozzle of the fluid dispensing system and wherein an absence of any force being applied to the second control device prevents the fluid from flowing out of the nozzle.

21. An apparatus comprising:

a structure;

an applicator associated with the structure;

a first control device associated with the structure, wherein applying a first force to the first control device causes the applicator to move relative to a center axis of the applicator;

a fluid dispensing system, wherein the fluid dispensing system is configured to dispense a high-viscosity fluid for delivery to the applicator; and a second control device associated with the structure, wherein applying a second force to the second control device causes the high-viscosity fluid to be delivered from the fluid dispensing system to the applicator;

wherein increasing a level of the second force being applied to the second control device increases a rate of flow of the fluid from the fluid dispensing system.

* * * * *